US012674104B2

(12) United States Patent
Webb et al.

(10) Patent No.: US 12,674,104 B2
(45) Date of Patent: Jul. 7, 2026

(54) HYDRO-DEALKYLATION PROCESS TO GENERATE HIGH QUALITY FUELS, BASE STOCKS AND WAXES

(71) Applicant: ExxonMobil Technology and Engineering Company, Annandale, NJ (US)

(72) Inventors: Jonathan D. Webb, Bridgewater, NJ (US); Shifang Luo, Annandale, NJ (US); Xinrui Yu, Furlong, PA (US); Hyung Suk Woo, Easton, PA (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 155 days.

(21) Appl. No.: 18/293,586

(22) PCT Filed: Aug. 2, 2022

(86) PCT No.: PCT/US2022/074407
§ 371 (c)(1),
(2) Date: Jan. 30, 2024

(87) PCT Pub. No.: WO2023/015168
PCT Pub. Date: Feb. 9, 2023

(65) Prior Publication Data

US 2024/0368484 A1 Nov. 7, 2024

Related U.S. Application Data

(60) Provisional application No. 63/230,214, filed on Aug. 6, 2021.

(51) Int. Cl.
*C10G 73/06* (2006.01)
*C10G 65/04* (2006.01)
(Continued)

(52) U.S. Cl.
CPC ..... *C10G 65/043* (2013.01); *C10G 73/06* (2013.01); *C10G 73/36* (2013.01); *C10G 73/44* (2013.01);
(Continued)

(58) Field of Classification Search
CPC .... C10G 2300/1033; C10G 2300/1037; C10G 2300/202; C10G 2300/301;
(Continued)

(56) References Cited

U.S. PATENT DOCUMENTS 2,787,582 A 4/1957 Watkins et al.
2006/0201851 A1 9/2006 Rosenbaum et al.
(Continued)

FOREIGN PATENT DOCUMENTS

GB 1064776 A * 4/1967 ..... C10G 47/00
GB 1176063 A 1/1970

OTHER PUBLICATIONS

International Search Report and Written Opinion for PCT/US2022/074407 dated Aug. 2, 2022.

*Primary Examiner* — Ellen M Mcavoy
*Assistant Examiner* — Chantel Graham
(74) *Attorney, Agent, or Firm* — C. Tumey Law Group PLLC

(57) ABSTRACT

Provided are methods of hydro-dealkylation of hydrocarbon feedstock to produce an intermediate hydrocarbon product having a boiling point at T10 of greater than about 500° F.+ by distillation method ASTM D7169 and a viscosity index greater than about 120 in accordance with ASTM D2270 where at least about 50 percent of the hydrocarbon feedstock is a SIMDIS of 400° F. The intermediate hydrocarbon product can be used to produce a base stock, a wax and/or paraffinic diesel.

25 Claims, 8 Drawing Sheets

(51) Int. Cl.
*C10G 73/36* (2006.01)
*C10G 73/44* (2006.01)

(52) U.S. Cl.
CPC ..... *C10G 2300/1033* (2013.01); *C10G 2300/1037* (2013.01); *C10G 2300/202* (2013.01); *C10G 2300/301* (2013.01); *C10G 2300/302* (2013.01); *C10G 2300/307* (2013.01); *C10G 2300/308* (2013.01); *C10G 2300/4006* (2013.01); *C10G 2300/4012* (2013.01); *C10G 2300/4018* (2013.01); *C10G 2400/04* (2013.01)

(58) Field of Classification Search
CPC ..... C10G 2300/302; C10G 2300/307; C10G 2300/308; C10G 2300/4006; C10G 2300/4012; C10G 2300/4018; C10G 2400/04; C10G 45/58; C10G 65/043; C10G 73/06; C10G 73/36; C10G 73/44
See application file for complete search history.

(56) References Cited

U.S. PATENT DOCUMENTS

| | | | | |
|---|---|---|---|---|
| 2016/0298048 | A1 | 10/2016 | Brown et al. | |
| 2019/0033820 | A1* | 1/2019 | Zhi ..... | G05B 19/404 |
| 2019/0338204 | A1 | 11/2019 | Calla et al. | |

* cited by examiner

HYDRO-DEALKYLATION PROCESS TO GENERATE HIGH QUALITY FUELS, BASE STOCKS AND WAXES

FIELD

The present disclosure relates to methods of producing base stock, paraffinic diesel, and wax product by hydro-dealkylation of hydrocarbon feedstocks having a paraffin to ring compound ratio in the vacuum gas boiling range of about 650° F. (340° C.) to 1050° F. (565° C.) of greater than 0.2.

BACKGROUND

Light crude oil such as tight oils with 35-55 API have comparatively low levels of refinery contaminants including metals, sulfur, and nitrogen. As a hydrocarbon feedstock, this type of crude can produce process intermediates with minimal processing useful in fuels, lubes and wax applications. In certain circumstances, additional processing such as hydroconversion, cracking, treating and/or extraction is needed to convert crude to refinery product streams. The problem is that certain crudes, such as light tight oil crude, are not directly suitable for high tier product applications such as paraffinic diesel and high-quality base stocks (Group III and/or Group III+) because of the presence of contaminants and insufficient native paraffin content.

In conventional processes to produce base stocks, crude oil is often vacuum distilled (fractionated under a vacuum) to provide a vacuum gas oil, which is subsequently fed to a hydroprocessing unit containing hydrotreating and hydrocracking catalysts. The first stage of hydroprocessing is followed by a stripping section where lighter, fuel-type components inclusive of diesel are removed. The remaining heavier fraction then enters a second stage processing where aromatic saturation, dewaxing, and hydrofinishing are performed. A second stripping process further removes fuel-type components, leaving the base stock product. Such processing requires intense hydrotreatment conditions to achieve high quality base stock product properties. In addition, harsher, more intense hydroprocessing steps, such as hydrocracking, are expensive to implement and perform. Alternative second stage processing can include solvent extraction inclusive of process units capable of manufacturing refined wax products inclusive of semi-refined, fully refined and/or scale wax.

SUMMARY

Provided herein are methods of hydro-dealkylation of hydrocarbon feedstocks to provide an intermediate hydrocarbon product comprising providing a hydrocarbon feedstock and reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce the intermediate hydrocarbon product having a T10 distillation point of greater than about 500° F.+ (260° C.) by distillation method ASTM D7169 and a viscosity index greater than about 120 in accordance with ASTM D2270. The hydrocarbon feedstock can comprise crude oil or a fractionated hydrocarbon stream or blend thereof having a paraffin to ring compound ratio in a VGO boiling range of between about 650° F. (340° C.) to 1050° F. (565° C.) greater than or equal 0.2 and at least about T50 percent of the hydrocarbon feedstock has a SIMDIS of 400° F. (204° C.).

In accordance with various embodiments of the invention, the intermediate hydrocarbon product can be used to produce a base stock, a wax and/or paraffinic diesel.

Further provided herein are methods of producing a base stock and/or wax comprising: providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2 and at least about T50 percent of the hydrocarbon feedstock has a SIMDIS of 400° F. (204° C.); and reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product. The intermediate hydrocarbon product is fractionated and further processed to produce a base stock and/or a wax, wherein the base stock and the wax each have a T10 distillation point of greater than about 650° F. (340° C.) by distillation method ASTM D7169 and a viscosity index greater than about 120 in accordance with ASTM D2270. Herein, base stocks are categorized according to the American Petroleum Institute (API) classifications based on saturated hydrocarbon content, sulfur level, and viscosity index. Petroleum waxes are categorized in *Developments of Petroleum* Science, Vol. 14, p. 13 (1982); Vol. 14, p. 141 (1982); Vol. 14, p. 240 and are often specified by melting point, penetration by ASTM D1321, viscosity by ASTM D445 and color.

Also provided are methods of producing at a paraffinic diesel comprising: providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2 and at least about T50 percent of the hydrocarbon feedstock has a SIMDIS of 400° F. (204° C.); and reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product. The intermediate hydrocarbon product is fractionated to produce a paraffinic diesel having a T50 distillation point of greater than about 470° F. (240° C.) and T90 distillation point of less than about 680° F. (360° C.) by distillation method ASTM D86 and Cetane number greater than or equal to 60 in accordance with ASTM 6870.

In accordance with the various embodiments of the invention, the paraffin to ring compound ratio is between about 0.4 to about 1.2, or about 0.6 to about 1.2. Furthermore, the hydrocarbon feedstock can have an API gravity between about 35 and about 55, about 40 and about 55, or about 45 and about 55 and comprise less than 0.5 wt. % sulfur.

These and other features and attributes of the disclosed methods of the present disclosure and their advantageous applications and/or uses will be apparent from the detailed description which follows.

BRIEF DESCRIPTION OF THE DRAWINGS

To assist those of ordinary skill in the relevant art in making and using the subject matter hereof, reference is made to the appended drawings, wherein.

DETAILED DESCRIPTION

Figure 1:
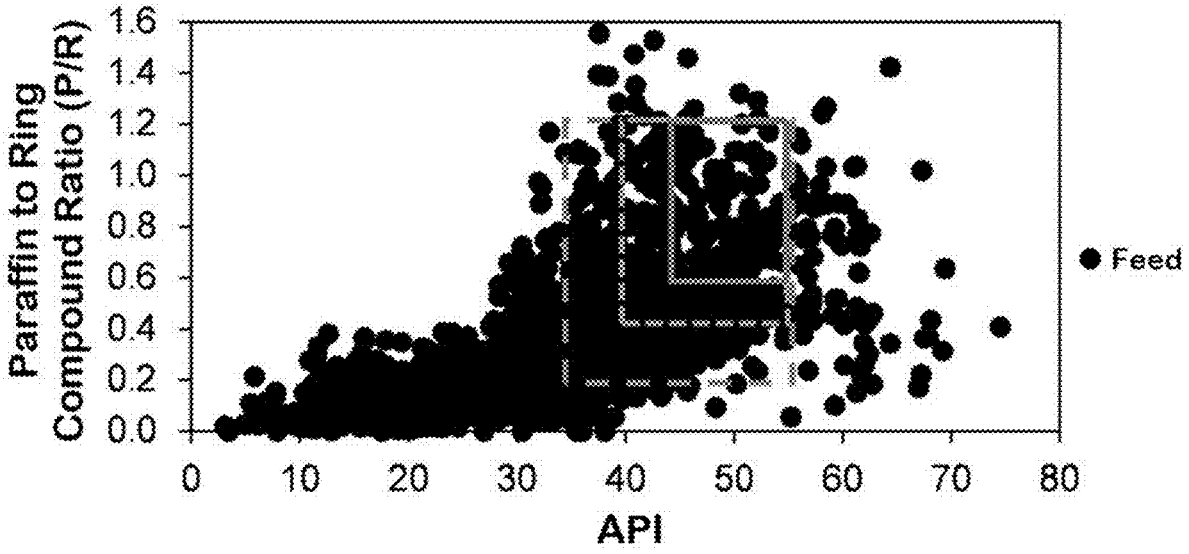
FIG. 1 is a graph showing the paraffin to ring compound ratio (P/R) for hydrocarbon feedstocks useful in the present hydro-dealkylation processes.

Before the present components, compositions, and/or methods are disclosed and described, it is to be understood that unless otherwise indicated this disclosure is not limited to specific compounds, components, compositions, reactants, reaction conditions, catalyst structures, or the like, as such may vary, unless otherwise specified. It is also to be understood that the terminology used herein is for the purpose of describing particular embodiments only and is not intended to be limiting.

All numerical values within the detailed description and the claims herein are modified by "about" or "approximately" the indicated value, and take into account experimental error and variations that would be expected by a person of ordinary skill in the art. All patents and patent applications, test procedures (such as ASTM methods, and the like), and other documents cited herein are fully incorporated by reference to the extent such disclosure is not inconsistent with this disclosure and for all jurisdictions in which such incorporation is permitted.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

For the purposes of this disclosure, the following definitions will apply:

As used herein, the terms "a" and "the" as used herein are understood to encompass the plural as well as the singular.

As used herein, the term "multi-ring species content" means a saturated or unsaturated hydrocarbon compound including or containing at least two closed ring moieties. When content is expressed in weight percent (wt. %) the stated percentage is with respect to total weight of the relevant sample material.

As used herein, the term "stage" refers to a process configuration, process flow, or process scheme that can correspond to a single reactor or a plurality of reactors provided in series. Optionally, two or more parallel reactors are used to perform the processes within a stage. Each stage and/or reactor can include one or more catalyst beds containing hydroprocessing catalyst or dewaxing catalyst. It is noted that a "bed" of catalyst can refer to a partial physical catalyst bed. For example, a catalyst bed within a reactor could be filled partially with a hydrofinishing catalyst and partially with a dewaxing catalyst. For convenience in description, even though the two catalysts are stacked in a single catalyst bed, the hydrofinishing catalyst and dewaxing catalyst can each, conceptually, be considered as separate catalyst beds or reactors.

As used herein, the phrase, a paraffin to ring compound ratio means and includes the wt. % ratio of total paraffins in the hydrocarbon feedstock to the sum of 1-ring species, multi-ring species, sulfides and polars content of the VGO (650-1050° F., 340-565° C.) boiling point fraction of the hydrocarbon feedstock. A method to measure this property is liquid chromatography (LC) combined gas chromatography mass spectrometry (GC/MS) as described in U.S. Pat. No. 8,682,597. Alternative methods based on spectroscopic, chromatographic or physical property measurements are applied to derive the weight ratio of paraffins to ring compounds.

As used herein, SIMDIS refers to the boiling range determination in wt. % of a material according to gas chromatographic techniques that include ASTM D2887 and/or ASTM D86 for petroleum distillates and/or ASTM D7169 for petroleum residues. According to these distillation methods the boiling range of petroleum material can be represented. Herein, references to T10, T50 and T90 represent the 10 wt. %, 50 wt. % and 90 wt. % boiling points within the boiling range of the material.

As used herein, MABP refers to the mean average boiling point in ° C. of a material (distillate, cut or residue) according to the SIMDIS. Mean average boiling point is calculated from the SIMDIS performed according to either D2887 for cuts and D7169 for residues. The parameter represents a boiling point range as a single characteristic boiling point. The purpose is to enable relative comparison of properties of VGO cuts such as LVGO, MVGO, HVGO and VTB of the hydrocarbon feedstocks and the intermediate hydrocarbon products.

As used herein, the phrase, boiling point conversion of the hydrocarbon feedstock means and includes conversion as calculated by measurement of the weight percent (wt. %) recovery of the total hydrocarbon effluent relative to the hydrocarbon feed for a designated period of process time and the measured SIMDIS of the hydrocarbon feed and hydrocarbon effluent. Calculation of boiling point conversion is completed according to the equation (1) where feed and effluent weight is measured in grams and SIMDIS wt. % is the distillation point as measured as weight percent off at a reference boiling temperature, such as 700° F. or 900° F., of the SIMDIS of the hydrocarbon feed and hydrocarbon effluent from a reactor.

$$\text{Boiling Point Conversion} = \frac{\text{effluent weight}}{\text{feed weight}} \times \frac{SIMDIS\ \text{wt.}\ \%_{effluent} - SIMDIS\ \text{wt.}\ \%_{feed}}{SIMDIS\ \text{wt.}\ \%_{feed}} \times 100\% \quad \text{Equation 1}$$

As used herein, the phrase, high quality base stock and/or Group III/III+ refers to base stocks or base oils that comprise the API definition of Group III and/or would otherwise be known to those familiar with the state of the art as Group III+ as defined herein.

As used herein, the phrase SDWO or solvent dewaxed oil refers to VGO that has been dewaxed by mixing with a solvent dewaxing solvent which can include methyl isobutyl ketone, methyl ethyl ketone or toluene. The mixture is chilled to target temperature and the crystallized wax is separated from the solvent mixture by filtration. Solvent is removed from the filtered oil by distillation processes.

The present methods generally relate to producing base stocks, paraffinic diesel and/or wax from various crude oil types, blends and fractionated intermediate products by hydro-dealkylation. More specifically, base stocks, paraffinic diesel and wax can be economically produced from a hydrocarbon feedstock having a paraffin to ring compound ratio in a vacuum gas oil boiling range of between about 650° F. (340° C.) and about 1050° F. (565° F.) greater than or equal to 0.2. An intermediate hydrocarbon product is produced having a boiling point at T10 of greater than about 500° F.+ (260°° C.) or greater than about 650° F.+ (340° C.) as measured by distillation method ASTM D7169, and also has a viscosity index greater than about 120 in accordance with ASTM D2270. At least about 50 percent of the hydrocarbon feedstock is converted to intermediate hydrocarbon product as measured relative to a SIMDIS of 400° F.

According to the present disclosure, various types of crude oils can be used as the hydrocarbon feedstock or used to derive the hydrocarbon feedstock via pre-processing. As described herein, suitable hydrocarbon feedstocks include whole and "topped" petroleum crudes as well as fractionated hydrocarbon streams and blends described herein.

Crudes and Crude Oil

Various characteristics and properties of crude oil are used as factors in determining its economic value and/or ultimate use and are often different according to geographic origin. Generally, crude oils will vary in composition according to the oil-producing basin or formation from which the crude has been extracted. FIG. 1 is a graph showing crude composition ranges according to the paraffin to ring compound ratio (P/R) that is useful in hydro-dealkylation as described herein. As shown in FIG. 1, the outer rectangle represents Crude Class I. The middle rectangular represents Crude Class II and the innermost rectangle represents Crude Class III.

For example, specific gravity (relative density of a substance to the density of water) of a crude oil is typically reported as API gravity (ASTM D287) and determined according to an industrial standard, such as ASTM D4052-16 and/or ASTM D287-12. An API gravity range differs according to the formation from which the crude is extracted and is used to screen characteristics of various crudes.

The paraffin to ring compound ratio (P/R) can be measured by liquid chromatography (LC) combined gas chromatography mass spectrometry (GC/MS) methods as described in U.S. Pat. No. 8,682,597. Herein the compound ratio is measured on the VGO (650-1050° F., 340-565° C.) boiling point fraction of the hydrocarbon feedstock. The paraffin to ring compound ratio (P/R) is the wt. % ratio of paraffins to the sum of 1-ring species, multi-ring species, sulfides and polars content of the VGO.

There are alternative methods to measure hydrocarbon feedstock composition known to those skilled in the art. For instance, the aromatic content of crude and other hydrocarbon feedstocks and products can be measured by various methods including chromatography and ultraviolet spectroscopy, such as those described in U.S. Publication No. 2013/0179092, published Jul. 11, 2013, which is incorporated herein by reference. Additionally, techniques such as mass spectroscopy and NMR spectroscopy can be used to establish detailed composition of a crude oil. The empirical n-d-M method (ASTM D3238-17) is also available for determining carbon type (paraffinic carbon, naphthenic carbon, and aromatic carbon) distributions in a sample oil by relatively simple measurements of physical parameters, such as refractive index (n), density (d) and molecular weight (M).

Further, detailed compositional analysis of crude oils can be made according to known methods, such that sulfur content, paraffin content, aromatic content, naphthene content, and multi-ring content, amongst other characteristics, can be determined for each crude type. However, measured and reported physical characteristics are not always easily correlated in a known manner to the potential end uses of a crude oil type.

Processing of Hydrocarbon Feedstock

According to an embodiment of the invention, methods of producing a base stock, paraffinic diesel and/or wax includes hydro-dealkylation of the hydrocarbon feedstock, such as crude oil feed, having a paraffin to ring compound ratio that is equal to or greater than about 0.2 and at least about T50 percent of the hydrocarbon feedstock has a SIMDIS of 400° F. (204° C.).

In this context, the term "crude oil feed" means and includes crude oil (also referred to as "crude"), blends of crude oil, or one or more fractionated hydrocarbon steams or blends thereof that have not been processed post-extraction. That is, other than any processing or alteration attendant to transportation from extraction site, the crude oil or crude oils of the crude oil feed are in an extracted state. Also, in this context, processing post-extraction excludes minor refining processes, such as atmospheric fractionation, that do not significantly alter the relevant characteristics of the crude. For example, crude oil according to the disclosure can be a "topped" crude, which is a crude that has been subjected only to atmospheric fractionation or the like for the removal of the highly volatile and fuel type components.

In a conventional process to produce high quality base stocks, crude is often vacuum distilled (fractionated under a vacuum) to provide a vacuum gas oil distillate, which is subsequently fed to a hydroprocessing unit. Conventionally, the first stage hydroprocessing unit contains a hydrotreating and hydrocracking catalyst. The first stage of hydroprocessing is followed by a stripping section where lighter, fuel-type components including diesel are removed. The remaining heavier fraction then enters a second stage processing where aromatic saturation, dewaxing, and hydrofinishing are performed. A second stripping process further removes fuel-type components, leaving the base stock product. In general, conventional processing utilizes hydrocracking processes in the first stage to achieve similar base stock product properties as those provided by the present methods. Additionally, the vacuum gas oil feedstock or the heavier fraction that is processed by the second stage can be blended with a waxy co-feed or solvent extracted to enable production of high-quality base stocks at lower capital cost than investment in harsher hydro-processing steps.

Harsher, more intense hydro-processing steps, such as hydrocracking, generally are more expensive to implement and perform. Thus, the present methods provide lower cost and/or more efficient hydrocarbon products and methods of making the same. The present process configurations can produce high-quality Group III base stock without the intensive hydroprocessing by hydrocracking in conventional schemes. Likewise, the process configurations of the present methods can eliminate the need for certain conventional processing steps, such as the fractionation (atmospheric and/or alternatively by vacuum) of an incoming crude feed prior to first stage processing and/or any hydrocracking processing. The use of crudes according to the present disclosure permits use of a simpler process scheme for the production of Group III/III+ base stocks, wax and paraffinic diesel.

Figure 2:
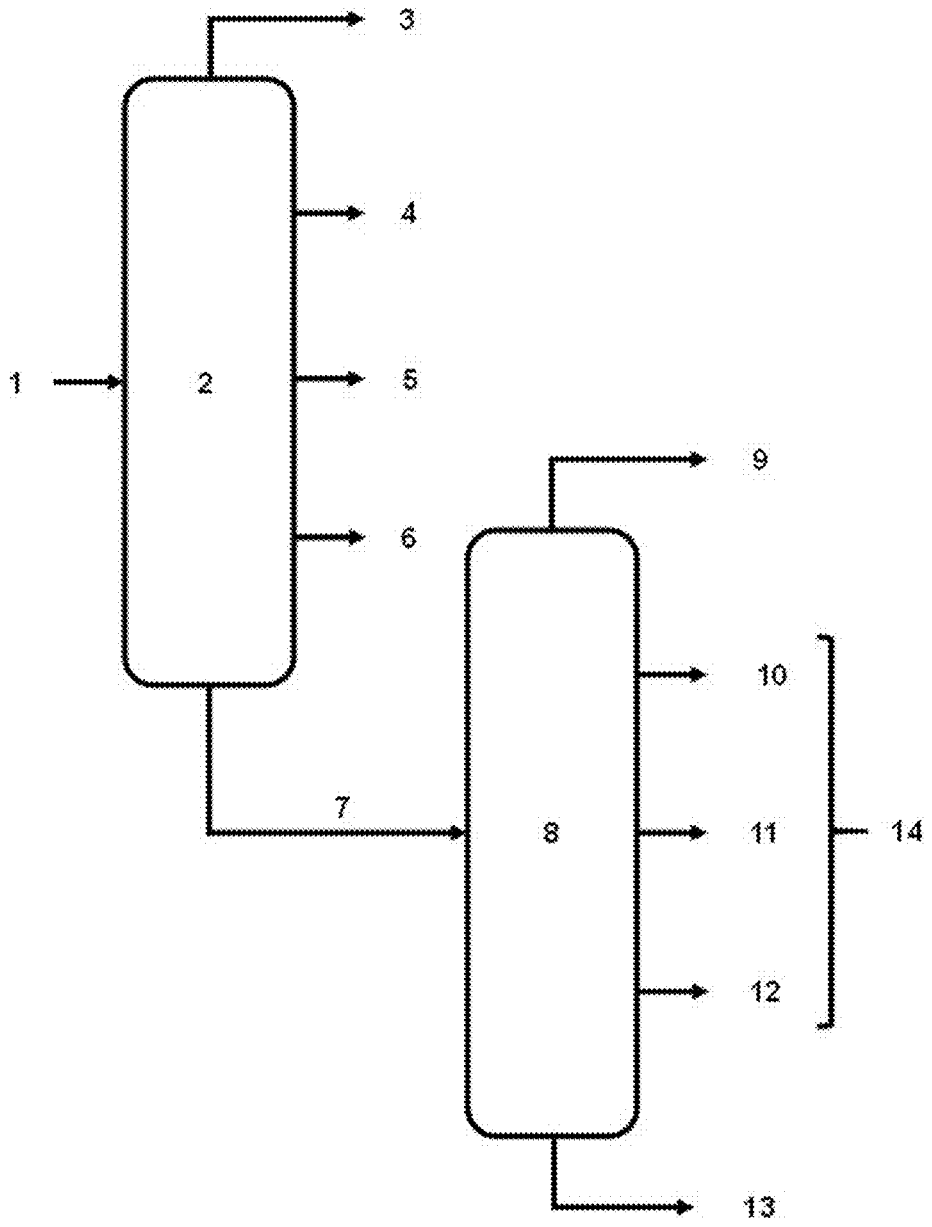
FIG. 2 is a general overview flowchart of crude oil distillation to generate feeds for hydro-dealkylation.

FIG. 2 provides a general overview and flowchart of crude oil distillation to generate hydrocarbon feedstocks useful in the present hydro-dealkylation processes. FIG. 2 depicts a general process configuration for crude distillation to generate hydrocarbon feedstock for hydro-dealkylation of the present methods. In FIG. 2, a stream of whole crude oil 1 is directly fed to an atmospheric distillation pipe still 2 to produce an effluent atmospheric tower bottom 7. An atmospheric distillation pipe still 2 provides at least an atmospheric distillation overhead 3 and atmospheric tower bottoms 7. Atmospheric tower bottoms 7 is a crude oil that has been subjected to atmospheric distillation to remove atmospheric distillate. Atmospheric tower bottoms have a nominal T10 cut point of 650° F. (340°° C.), T50 of 800° F. (425° C.) and has an end boiling point greater than 1050° F. (565° C.).

As shown in FIG. 2, the atmospheric distillation pipe still 2 further provides naphtha distillate 4, kerosene distillate 5, and diesel distillate 6 side streams (also referred to herein as a "cut" or "fractionate"). The effluent of the atmospheric distillation pipe still 2, atmospheric tower bottoms 7, is in fluidic communication with a vacuum distillation pipe still 8. The vacuum distillation pipe still 8 produces at least a vacuum distillation overhead 9 and a vacuum tower bottom 13. Additional fractionate include light vacuum gas oil 10, medium vacuum gas oil 11, and heavy vacuum gas oil 12 as side streams. Generally, light vacuum gas oil 10, medium vacuum gas oil 11, and heavy vacuum gas oil 12 are referred to as vacuum gas oil 14 (VGO) according to an embodiment of the invention.

The hydrocarbon feedstock used in the present methods can be a whole crude oil, atmospheric tower bottoms ("ATB"), vacuum gas oil ("VGO") or vacuum tower bottoms ("VTB"). The hydrocarbon feedstock can be produced through distillation at a petroleum refinery. Whole crude oil is a petroleum material recovered from conventional or unconventional processes and can be used in the present methods without prior fractionation.

Vacuum distillation produces one or multiple fractionate: light vacuum gas oil ("LVGO"), medium vacuum gas oil ("MVGO"), and/or heavy vacuum gas oil ("HVGO") in the boiling range of between about 650° F. (340° C.) and about 1050° F. (565° C.). In general, VGO cuts having higher boiling points (LVGO<MVGO<HVGO) are useful under the present hydro-dealkylation conditions because these cuts typically contain higher concentrations of ring species available for conversion. Vacuum tower bottom ("VTB") refers to the bottoms of a vacuum distillation pipe still to produce a cut with a nominal T10 cut point of equal to or greater than about 880° F. (470° C.) and between about 880° F. (470° C.) and about 1050° F. (565° C.) depending on the fractionating unit.

In the present methods, whole crude oil, vacuum gas oil, atmospheric tower bottoms or vacuum tower bottoms are subject to hydro-dealkylation processing conditions which cleave C—C bonds adjacent to rings in a manner that causes an increase in the paraffinic character of a processing stream and allows use of lower quality feedstocks for higher tier product production. The outcome is a diesel and VGO cut which are advantageous for applications as paraffinic diesel and VGO feedstock to produce Group III, Group III+ base stocks ("Grp III+ base stocks"). Paraffinic diesel is a clean and a higher efficient diesel product for its high paraffinic content, low aromatics and low sulfur contents. In accordance with EN15940, paraffinic diesel specifications include: (1) Cetane number>=70; (2) aromatics<=1.1 wt. %; (3) sulfur<=5.0 ppm; and (4) carbon residue<=0.3 wt. %.

In the present methods, light crude can be reacted in a fixed bed hydro-dealkylation unit or by hydro-processing without the need of solvents such as 1,3,4-trimethylbenzene or 1-methyl naphthene or in solvent assisted resid conversion processes such as visbreaking. Typically, the purpose for a solvent is to promote mass transfer of coke pre-cursors. The hydrocarbon feedstock is less prone to form and to have mass transport limitations for coke precursors due to the comparatively low contaminant levels (metals by ASTM D8056-18, n-heptane insoluble by ASTM D6560-17) as opposed to heavier crudes. Alternatively, crude can be de-asphalted, extracted prior and/or distilled to generate a 1050° F. (565)° cut in an effort to remove asphaltenes or aromatic components prone to forming coke precursors.

With conventional and severe hydroprocessing conditions a minimum wax concentration of about 15 to about 17 wt. % dry wax depending on the hydrocarbon feedstock is necessary to achieve high quality base stock quality at viable yield targets with either conventional hydroprocessing. Increasing the wax content of a low wax hydrocarbon feedstock (below 15 wt. %) is achieved economically by purchasing a high wax crude oil and/or through wax injection/blending (Foots Oil, Slack Wax, Waxy Crude Oil such as Utah Yellow Wax individually or in combination). Another option is to concentrate wax in the hydrocarbon feedstock through solvent extraction.

One of the advantages of the present methods is the enlargement of the types of hydrocarbon feedstock which can produce a high-quality base stock, wax and/or paraffinic diesel with a simplified process scheme. By way of example, the present methods include a Stage 1 (first stage) process where a hydro-dealkylation reactor is loaded with a low acidity hydrotreating catalyst and is fed by whole crude, ATB or VTB feedstock. After Stage 1 process, a fractionating unit generates fuel cuts which are a paraffinic diesel and a VGO cut (also referred to herein as a "stream"). Stage 2 (second stage) converts the VGO cut to a high-quality base stock by aromatic saturation, catalytic dewaxing, hydrofinishing and fractionation. Alternatively, the VGO cut is processed to produce a refined wax through solvent processing and hydrofinishing.

Hydro-dealkylation enables high quality base stock and paraffinic diesel manufacturing from a light tight oil crude, and under the proper conditions, is a highly selective process for paraffin concentration. The present methods also enable wax production from the same type of hydrocarbon feedstock.

Hydro-Dealkylation Process Boundaries

The term, "hydro-dealkylation" as used herein means and refers to a reactive condition that results in the selective cleavage of C—C bonds adjacent to ring structures. Table 1 below sets out general process boundaries for the hydro-dealkylation reaction. Under the hydro-dealkylation conditions, n-paraffins and iso-paraffins are selectively preserved in the hydrocarbon feedstock and that the ring species would undergo boiling point conversion. Boiling point conversion manifests as a rain-down effect of the lower molecular weight ring and chain species from cleavage of a C—C bond in conjunction with other reactions that reduce molecular weight or polarity. The reactive conditions for hydro-dealkylation are also amenable to other boiling point conversion reactions such as hydro-denitrification, hydro-desulfurization, ring cleavage and aromatic saturation. A successful outcome of hydro-dealkylation conversion of a hydrocarbon feedstock is measured as increased wax/paraffinic content of the original boiling range of the feed as well as a reduction in contaminants such as sulfur and nitrogen.

TABLE 1

Example Hydro-dealkylation Process Conditions

| | |
|---|---|
| Feed Type | Crude or Crude Distillate |
| Hydrogen Pressure, PSIG | 400-2400 |
| Temperature, ° F. (° C.) | 500-1200 (260-565) |
| Catalyst | NiMo, CoMo, NiW |
| LHSV, $hr^{-1}$ | 0.2-4.0 |
| Hydrogen Treat Ratio, SCF/BBL | 200-6000 |

Hydro-Dealkylation Chemistry

The hydro-dealkylation reaction of the present methods occurs on the alkyl chain(s) of aromatic and naphthenic components of the hydrocarbon feedstock. As shown in reaction scheme 1 below, the reaction mechanism of hydro-dealkylation is catalytic and thermal driven C—C bond cleavage to generate a transient carbon centered radical that is quenched by hydrogen radicals generated from hydrogen by a hydrotreating catalyst. In the present methodologies, use of excess hydrogen mitigates potential for molecular weight growth and formation of coke. Further, selecting hydrocarbon feedstock that has a low concentration of coke precursors (i.e., asphaltenes) is beneficial to hydro-dealkylation reactivity. Otherwise, the hydrocarbon feedstock can require clean-up steps to sustain reactivity without fouling or coke formation. As shown in reaction scheme 1 below, the selectivity of the catalytic and thermal C—C bond cleavage is determined by C—C bond strength that is governed by the stability of the associated carbon centered radicals. In aromatic species C—C bond cleavage occurs between the C(α) and C(β) to the ring generating a benzylic and an alkyl radical. In naphthenic species C—C bond cleavage occurs between the ring and the C(α) generating a secondary carbon radical and an alkyl radical.

Reaction Scheme 1

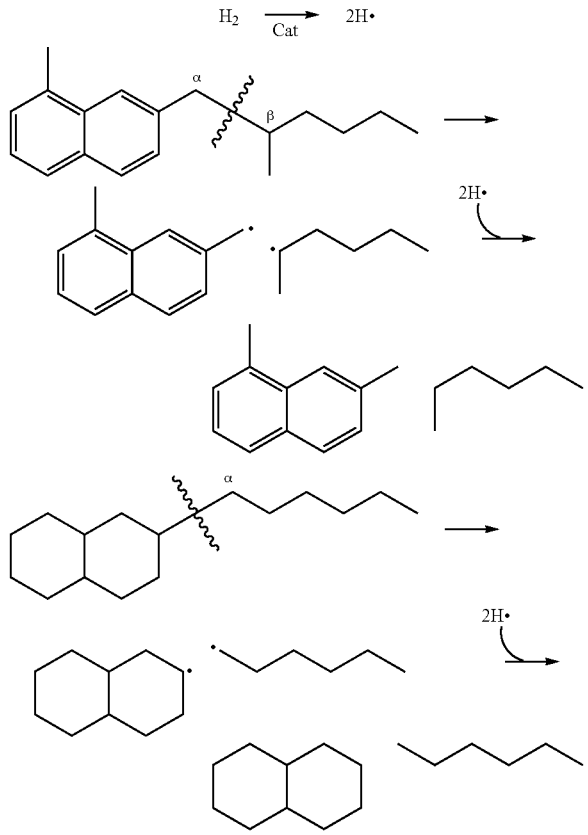

Hydro-Dealkylation Feed—Hydrocarbon Feedstock

For the present methods, as set out in FIG. 1 and Table 2 below, a hydrocarbon feedstock for a hydro-dealkylation process is characterized by properties of the whole crude oil, ATB (650° F.+) and VGO (650° F./340°° C. to about 1050° F./565° C.). Boiling ranges of ATB and VGO are set by simulated distillation methods such as ASTM D2887 for petroleum distillates and ASTM D7169 for petroleum residues. Hydro-dealkylation within the context of the present methodologies can process whole crude or a cut of a whole crude source of hydrocarbon feedstock. Deasphalting, extraction and/or distillation can be used to prepare the hydrocarbon feedstock for use with the present methods.

In the present methodologies, the hydrocarbon feedstock is a single crude oil (sometimes referred to as "crude") or a blend of crude oil ("crude blends" or "blends") within the API range of about 35 to about 55 API. As used in the present methods, the hydrocarbon feedstock has a paraffin to ring compound ratio greater than or equal 0.2. The paraffin to ring compound ratio is measured on the VGO (650-1050° F., 340-565° C.) boiling range of the feedstock. For feedstocks that have been treated to vacuum distillation such as VTB that have an initial boiling point or T10 boiling point greater than 650° F. the paraffin to ring compound ratio is measured on the VGO (650-1050° F., 340-565° C.) distilled from the feedstock processed by the vacuum fractionator. The paraffin to ring compound ratio is a ratio by weight percent of the amount of paraffin to the combined amount of naphthene and the aromatics in the hydrocarbon feedstock.

The paraffin to ring compound ratio is measured by methods described in U.S. Pat. No. 8,682,597. Multiple liquid chromatography (LC) separations of VGO (650-1050° F., 340-565° C.) provide saturate, aromatic, sulfide and polar fractions. The saturate fraction contains molecules with aliphatic carbons and include paraffins and naphthenes. The aromatic fraction contains molecules with at least 1 aromatic rings. The sulfide fraction molecules contain aliphatic sulfur and the polar fraction contain acid or basis nitrogen molecules. The liquid chromatography separation provides the material balance of the VGO (650-1050° F., 340-565° C.).

The saturate, fraction is analyzed by GC/MS in electron impact mode. The GC/MS method provides the molecular weight distribution and is applied to determine the X-Class. X-Class is the parameter in U.S. Pat. No. 8,682,597 that organizes hydrocarbons into a homologous series based on hydrogen deficiency. It is calculated as the remainder of the molecular weight divided by 14. X-Class is able to assign hydrogen deficiency to saturate molecules that would be associated with the presence hydrocarbon rings. Saturate molecules with hydrogen deficiency by this method are classified as naphthenes. In certain samples, there is an ambiguity in X-Class determination between paraffins and naphthenes by GC/MS. For these materials, the GC/MS method can be supplemented by Supercritical Fluid Separation (SFC) of the saturate fraction to confirm X-Class assignment.

The paraffin to ring class ratio of VGO (650-1050° F., 340-565° C.) is calculated from the mass balance of the LC separations and GC/MS data collected on the saturate fraction. The weight proportion of paraffin is the mass of the saturate fraction by LC separation modified by the proportion of the saturate fraction analyzed by GC/MS, optionally supplemented by SFC, with an X-Class consistent with paraffin molecular structure. The weight proportion of naphthenes is the mass of the saturate fraction by LC separation modified by the proportion of the saturate fraction analyzed by GC/MS, optionally supplemented by SFC, with an X-Class consistent with naphthene molecular structure. The weight proportion of aromatics, sulfides and polars are as per the mass balance of the LC separations. The paraffin to ring class ratio is calculated as the weight ratio of paraffin (wt. %) to the sum of naphthene (wt. %), aromatics (wt. %), sulfides (wt. %) and polars (wt. %).

Alternative methods based on spectroscopic, chromatographic or physical property measurements are applied to derive the weight ratio of paraffins to ring compounds. An example includes but not limited to methods based on physical property measurements and infra-red (IR) spectrum as described in U.S. Publication No. 2020/0103390.

As used in the present methodologies, an API range is divided into three classes, each class illustrative of different process severity (reactor temperature, pressure and space velocity) requirements to achieve equivalent quality of high-quality base stock, paraffinic diesel and concentration of wax. Process severity is linked to level of contaminants such as sulfur, nitrogen and aromatics in the feedstock which is correlated to API.

Specifically, Class I Crude (API 35-55, Paraffinic to ring ratio 0.2-1.2) represents favored sources of the hydrocarbon feedstock used in connection with the present methods of hydro-dealkylation. Class II Crude (API 40-55, Paraffin to ring compound ratio 0.4-1.2) represents a subset of Class I crude and represent sources of the hydrocarbon feedstock which can have lower relative process severity to achieve desired product qualities due to lower contaminant levels and higher initial concentration of desired paraffinic species. Class III Crude (API 45-55, Paraffin to ring compound ratio 0.6-1.2) represents a subset of Class II Crude sources of the hydrocarbon feedstock that would be expected to have the lowest relative process severity to achieve desired product qualities due to lowest contaminant levels and highest initial concentration of desired paraffinic species. Class III Crudes when processed in connection with the present methods would be expected to have lowest level of process severity, highest yields of targeted products produced by the present methods (i.e., high quality base stock, paraffinic diesel and wax). Hydrocarbon feedstocks having less than 35 API might require additional steps to "clean-up" or solvent co-processing the hydrocarbon feedstock without which the present methods of hydro-dealkylation diminish the advantage for this type of process. Clean-up steps could include solvent de-asphalting, solvent extraction, vacuum distillation to remove 1050° F.+ (565° C.+) and/or hydroprocessing with demetallation catalysts prior to hydro-dealkylation processing. Crudes >55 API would likely be too low in 650° F.+ (343° C.+) weight or volume yield on distillation to be viable for hydro-dealkylation processing.

TABLE 2

Hydrocarbon Feedstocks Suitable for Hydro-Dealkylation Processing

| Crude Class | Method | I | II | III |
|---|---|---|---|---|
| Description | | Favored | Advantaged | Particularly Advantaged |
| API | ASTM D4052 | 35-55 | 40-55 | 45-55 |
| Paraffin to Ring Compound Ratio VGO (650-1050° F.) | U.S. Pat. No. 8,682,597 | 0.2-1.2 | 0.4-1.2 | 0.6-1.2 |
| Sulfur 650° F.+, wt. % | ASTM D2622 | <=3 | <=1 | <=0.5 |
| Nitrogen 650° F.+, ppm | ASTM D5762 | <=2000 | 50-1500 | 50-1000 |
| NHI 650° F.+, wt. % | ASTM D3279 | <=1 | <=0.5 | <=0.4 |

As provided in Table 2 and FIG. 1, a paraffin to ring compound weight ratio is designated as Paraffin/Ring Weight Ratio, paraffin/ring ratio (P/R) or compound ratio (P/R) and is the same as a weight percent ratio of paraffin to a combination of naphthene and aromatics.

As described herein, the hydrocarbon feedstock is a whole crude, a blend of crudes or a blend of crudes and other process streams or types of hydrocarbon feeds. The hydrocarbon feedstock is a process stream of hydrocrackates or hydrotreated distillates and bottoms. Other types of hydrocarbon feedstocks are used oil or bio-feeds. The hydrocarbon feedstock used in the present methods has properties as defined in Table 1 above, and is at least 80% petroleum hydrocarbon.

The hydrocarbon feedstock used in the present methods is a whole crude oil, ATB, VGO or VTB. The hydrocarbon feedstock is produced through distillation at a petroleum refinery. FIG. 2. Whole crude oil is a petroleum material recovered from conventional or unconventional processes and can be used in the present methods without prior fractionation. As shown in FIG. 2, ATB refers to a crude oil that has been subjected to atmospheric distillation to remove atmospheric distillate with a nominal cut point of 650° F. (340° C.) and has an end boiling point greater than 1050° F. (565° C.). As used herein, VGO refers to an ATB that has been subjected to a vacuum distillation to produce a one or multiple cuts: light vacuum gas oil, medium vacuum gas oil, heavy vacuum gas oil in the boiling range of between about 650° F. (340° C.) and about 1050° F. (565° C.).

The present methods can use a hydrocarbon feedstock which is a blend of any proportion of individual component streams such as but not limited to VGO and VTB, VGO and ATB, ATB and crude oil, ATB and VTB, MVGO and HVGO, LVGO and HVGO. Furthermore, any application of distillation can provide hydrocarbon feedstocks having properties not set forth in Table 2 but can be amenable to hydro-dealkylation processing in any event. For example, deep distillation used to remove 1050° F.+ (565° C.+) asphaltenes are prone to coking from the hydro-dealkylation hydrocarbon feedstock.

Hydro-Dealkylation Process Overview

As described above, the present methods use a hydro-dealkylation process to selectively convert heavy alkylated ring (aromatic, naphthene) species into lower molecular weight paraffins and ring structures through a thermal cleavage of a C—C bond adjacent to a ring. Reaction Scheme 1. For this conversion, a fixed-bed reactor operating within the boundaries set out in Table 1 can be used. The hydrocarbon feedstock feed to a hydroprocessing unit (i.e., a fixed-bed reactor) is a crude oil, blend or fractionated stream as shown in FIG. 2. The hydrocarbon feedstock is then provided to the fixed bed reactor under hydrogen pressure. After the reaction is complete, effluent from the hydroprocessing unit can be fractionated into distillate cuts/streams for downstream applications. The product stream of the hydro-dealkylation process suitable for downstream applications is also referred herein to as an intermediate hydrocarbon product and has a boiling point at T10 of greater than about 500° F.+ (260° C.+) by distillation method ASTM D7169. Applications for various cuts/streams include, but are not limited to, naphtha, kerosene/jet and diesel/paraffinic diesel for atmospheric distillate, base stocks/wax for VGO, bright stock for VTB, fuel oil for VTB or additional hydroprocessing (FCC, Coker, and the like) for any cut/stream.

In accordance with an embodiment of the invention, the fixed bed reactor is loaded with a hydrotreating catalyst such as a catalyst comprising at least one Group 8-10 non-noble metal (for example selected from Ni, Co, and a combination thereof) and at least one Group 6 metal (for example selected from Mo, W, and a combination thereof). Such a catalyst can include a suitable support and/or filler material (e.g., comprising alumina, silica, titania, zirconia, or a combination thereof). Alternatively, the catalyst is provided as bulk metal catalyst particles. By way of illustration, some examples of suitable hydrotreating catalysts are described in the following publications that are incorporated by reference herein: U.S. Pat. Nos. 6,156,695, 6,162,350, 6,299,760, 6,582,590, 6,712,955, 6,783,663, 6,863,803, 6,929,738, 7,229,548, 7,288,182, 7,410,924, 7,544,632, and 8,294,255, U.S. Publication Nos. 2005/0277545, 2006/0060502, 2007/0084754, and 2008/0132407, and International Publication Nos. WO 2004/007646, WO 2007/084437, WO 2007/084438, WO 2007/084439, and WO 2007/084471, inter alia. The choice of catalyst(s) depends on the specific application of the hydro-dealkylation in terms of type of hydrocarbon feedstock and quality of the effluent.

A hydrotreating catalyst for hydro-dealkylation is a bulk metal catalyst, or a combination of stacked beds of supported and bulk metal catalyst. By bulk metal, it is meant that the catalysts are unsupported wherein the bulk catalyst particles comprise 30-100 wt. % of at least one Group 8-10 non-noble metal and at least one Group 6 metal, based on the total weight of the bulk catalyst particles, calculated as metal oxides and wherein the bulk catalyst particles have a surface area of at least 10 $m^2/g$. Furthermore, bulk metal hydrotreating catalysts used herein comprise 50 to 100 wt. %, and 70 to 100 wt. %, of at least one Group 8-10 non-noble metal and at least one Group 6 metal, based on the total weight of the particles, calculated as metal oxides. The amount of Group 6 and Group 8-10 non-noble metals can be determined via TEM-EDX. Examples of suitable hydrotreating catalysts include, but are not limited to, Albemarle KF 848, KF 860, KF 868, KF 870, KF 880, KF 861, KF 905, KF 907, RT-621, Nebula and Celestia; Criterion LH-21, LH-22, and DN-3552; Haldor-Topsøe TK-560 BRIM, TK-562 HyBRIM, TK-565 HyBRIM, TK-569 HyBRIM, TK-907, TK-911, and TK- 951; Axons HR 504, HR 508, HR 526, HR 544 and HRK 1448. Hydro-dealkylation is carried out with one catalyst or combinations of the previously listed hydrotreating catalysts.

By contrast hydrocracking catalysts are prone to promote paraffin cracking and reduce the quality of the intermediate hydrocarbon product for production of paraffinic diesel, high quality base stocks and/or wax. Standard hydrocracking catalyst, for example, include a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which zeolitic base can advantageously be loaded 20 with one or more active metals (e.g., either (i) a Group 8-10 noble metal such as platinum and/or palladium or (ii) a Group 8-10 non-noble metal such nickel, cobalt, iron, and combinations thereof, and a Group 6 metal such as molybdenum and/or tungsten). In this discussion, zeolitic materials are defined to include materials having a recognized zeolite framework structure, such as framework structures recognized by the International Zeolite Association. Such zeolitic materials can correspond to silicoaluminates, silicoaluminophosphates, aluminophosphates, and/or other combinations of atoms that are used to form a zeolitic framework structure. In addition to zeolitic materials, other types of crystalline acidic support materials can also be suitable. Optionally, a zeolitic material and/or other crystalline acidic material are mixed or bound with other metal oxides such as alumina, titania, and/or silica. Details on example hydrocracking catalysts are found in U.S. Publication No. 2015/0715555.

For example, catalysts with acidity inclusive of phosphate and fluoride modification of an alumina ($Al_2O_3$) support are ideal appropriate to produce a high quality base stock by hydro-dealkylation but have value to fuels applications such as production of paraffinic diesel shown in Table 3. Acidity of a catalyst can be measured by a number of known methods. A non-limiting example of a parameter for inferring acidity is the cracking and isomerization tendency of a catalyst by the Alpha value test. The Alpha value test is a measure of the cracking activity of a catalyst and is described in U.S. Pat. No. 3,354,078 and in the *Journal of Catalysis*, Vol. 4, p. 527 (1965); Vol. 6, p. 278 (1966); and Vol. 61, p. 395 (1980), each incorporated herein by reference as to that description. The experimental conditions of the test referenced herein include a constant temperature of 538° C. and a variable flow rate as described in detail in the *Journal of Catalysis*, Vol. 61, p. 395. The "Alpha Value" is the cracking rate of a feed in reference to a standard sample of silica alumina. Catalysts that are conventionally believed to be suitable for hydrocracking activity can have Alpha values of at least about 25, or at least about 50, or at least about 100. Such catalysts can include amorphous catalysts, such as amorphous silica-alumina or alumina supports or additives and zeolites. Under certain reaction conditions, catalyst acidity (Alpha value of at least about 25) can lead to unselective wax isomerization and/or wax cracking diminishing base stock/wax value of the VGO range product. By contrast, a paraffinic diesel product produced with a high acidity catalyst can have improve cold flow properties (i.e., Cloud Point by ASTM D2500-17, Pour Point by ASTM D97-17) because of isomerization and paraffin cracking.

Table 3 illustrates the impact of relative catalyst acidity. The relatively lower acidity catalyst is a $CoMo/Al_2O_3$ material, the relatively higher acidity catalyst is a sulfided $NiMo/Al_2O_3$ material. Both are commercially available. The whole crude feed was a Class III Crude with API of 48.5 and paraffin to ring carbon ratio of 0.64 and T50 boiling point of 420° F. (215° C.). The feed was processed under hydro-dealkylation conditions across both catalysts at 1000 PSIG, with an equivalent isothermal temperature of 780° F. (415°° C.), linear hourly space velocity (LHSV) of 0.3-1.0 $hr^{-1}$ and total gas rate of 2500-3000 SCF/BBL. The hydro-dealkylation condition was monitored by boiling point conversion at 700° F. for both catalysts under isothermal conditions. The 700° F. conversion was 62% and 57% for the lower and higher acidity catalysts respectively.

The resulting intermediate hydrocarbon product was fractionated to produce VGO cuts that were amenable to high quality base stock (VI>120) and/or wax production and fuels cut that is suitable for high quality diesel (Cetane Number>60). The VGO from the lower acidity catalyst was advantaged in VI (147 vs 137) and dry wax (30 vs 13 wt. %) content relative to the higher acidity catalyst. The SDWO VI of both VGOs were comparable. SDWO VI is the viscosity index of the solvent dewaxed oil of the VGO cut of the intermediate hydrocarbon product. The diesel cut of the intermediate hydrocarbon product from the lower acidity catalyst and higher acidity catalyst had Cetane number>60 but distinct cold flow properties as measured by Pour Point (3° C. vs −23° C.) and Cloud Point (7° C. vs −13° C.). The example illustrates that higher acidity hydrotreating catalyst under hydro-dealkylation conditions directionally can reduce VI, lower wax yield of the VGO and lower Cetane number and improved cold flow properties of the diesel. These observations are consistent relatively higher wax cracking and isomerization promoted by catalyst acidity.

TABLE 3

Impact of Catalyst Acidity on Property of Fuel and Base Stock Products of Hydro-Dealkylated Intermediate Hydrocarbon Products from a Class III Crude

| Description | Lower Acidity Catalyst Product | Higher Acidity Catalyst Product |
|---|---|---|
| Catalyst | Sulfided Co/Mo $Al_2O_3$ | Sulfided NiMo/$Al_2O_3$ |
| 700° F.+ Conv, wt. % | 62 | 57 |
| | VGO (T10 650° F.-T90 1050° F.) | |
| Dry Wax, wt. % | 30 | 13 |
| VI | 147 | 137 |
| SDWO VI | 124 | 126 |
| MABP, ° C. | 405 | 423 |
| SIMDIS T10, ° C. | 361 | 376 |
| SIMDIS T90, ° C. | 454 | 478 |
| | Paraffinic Diesel (T50 470° F.-T90 680° F.) | |
| Cetane Number | 75 | 64 |
| Pour Point, ° C. | 3 | −23 |
| Cloud Point, ° C. | 7 | −13 |

In addition to loading of hydrotreating catalyst, a fixed-bed reactor comprising demetallation catalyst can be used to adsorb metal contaminants from the hydrocarbon feedstock and improve life cycle of the reactor. Optionally, the bottom of the reactor is loaded with a dewaxing catalyst that selectively isomerize paraffins or hydrocracking catalyst to improve low temperature properties of fuel distillate such as paraffinic diesel cloud point.

The primary function of the hydrotreating catalyst of the present methods is to promote hydrogen cleavage to generate hydrogen radicals which will react and quench the radicals formed from catalytic and thermal C—C bond cleavage reactions. The secondary function of the hydrotreating catalyst is to promote hydrodesulfurization and hydrodenitrification reactions to convert petroleum nitrogen and sulfur and to promote aromatic saturation. A target for contaminants sulfur, nitrogen and aromatic saturation are application specific. For instance, in a base stock application the target for sulfur and nitrogen in the effluent of the reaction is less than 35 ppm and less than 10 ppm, respectively as measured by elemental techniques according to ASTM D8056-18.

Base Stocks

Base stock is a key constituent in finished lubricants such as engine oils, crankcase lubricants, and various industrial lubricants. In general, finished lubricants comprise at least one base stock along with various additives for altering and/or improving characteristics of the lubricant. In some instances, a blend of base stocks, referred to as a base oil, is utilized in the finished lubricants.

As provided in Table 4, base stocks are categorized according to the American Petroleum Institute (API) classifications based on saturated hydrocarbon content, sulfur level, and viscosity index. Typically, Group I, II, and III base stocks are each derived from crude oil via extensive processing, such as fractionating, solvent extraction, solvent dewaxing, and hydroisomerization. Group III base stocks can also be produced from synthetic hydrocarbon liquids obtained from natural gas, coal, or other fossil resources. Group IV base stocks are polyalphaolefins (PAOs), and are produced by the oligomerization of alpha olefins. Group V base stocks include all base stocks that do not belong to Groups I-IV, such as naphthenics, polyalkylene glycols (PAG), and esters. Additionally, there are the informal categories of base stocks referred to as "Group II+" and "Group III+" that are generally recognized within the lubricant industry as corresponding to base stocks that exceed the minimum classification requirements of the formal group. For example, a "Group II+" base stock can have a viscosity index (VI) above 110 and a "Group III+" base stock can have a viscosity index (VI) between 130 and 150. Group III+ base stocks have properties tailored specifically to application. In addition to viscosity index, control of properties such as CCS (Cold Crank Simulator by ASTM D5293-20) and Noack (ASTM D5800-18).

TABLE 4

American Petroleum Institute Classifications of Group I-Group V API Classification

| Property | Group I | Group II | Group III | Group IV | Group V |
|---|---|---|---|---|---|
| % Saturates | <90 | ≥90 | ≥90 | Polyalpha-olefins (PAOs) | All others not belonging to Group I-V |
| % Sulfur | >0.03 | ≤0.03 | ≤0.03 | | |
| Viscosity Index (VI) | 80-120 | 80-120 | ≥120 | | |

Aromatic content of base stocks, paraffinic diesel and wax is measured by various methods including chromatography and ultraviolet spectroscopy, such as those described in U.S. Publication No. 2013/0179092, published Jul. 11, 2013, which is incorporated herein by reference. Additionally, techniques such as mass spectroscopy and NMR spectroscopy is used to establish detailed composition of a crude oil. The empirical n-d-M method (ASTM D3238-17) is also available for determining carbon type (paraffinic carbon, naphthenic carbon, and aromatic carbon) distributions in a sample oil by relatively simple measurements of physical parameters, such as refractive index (n), density (d) and molecular weight (M).

A class of heavier base stock formed from vacuum resid is called bright stock. A Group I bright stock is made conventionally from deasphalting of a vacuum resid commonly with propane deasphalting. Alternatively, a Group II bright stock is made by deasphalting and hydroprocessing the deasphalted vacuum resid to remove contaminants including methods described in U.S. Pat. No. 10,808,185.

Production of Base Stocks

In accordance with this disclosure, crude oils having particular characteristics can produce high yields of high-quality Group III/III+ base stock. Additionally, crude oils having these particular characteristics are processed to provide Group III/III+ base stock via simplified production process flows according to the present disclosure. The simplified process flows provide a possible reduction in production costs for base stocks. Furthermore, certain crude oils processed via the disclosed simplified process flows can be available at lower cost, in some instances, within particular geographic regions than crude oils presently considered desirable for Group III/III+ base stock production.

According to an embodiment, the Group III base stocks produced according to the present disclosure have less than 0.03 wt. % sulfur, a Pour Point of −10° C. to −30° C., a Noack volatility of 0.5 wt. % to 20 wt. % a CCS (cold crank simulator) value at −35°° C. of 100 cP up to 70,000 cP by ASTM D5293, and naphthene content of 30-70 wt. %. Group III base stocks produced according to the present disclosure are light neutral, medium neutral, or heavy neutral bask stocks and have a KV100 in a range of 2 cSt to 15 cSt.

The processing flows of the present disclosure intake a hydrocarbon feedstock and provide a base stock, paraffinic diesel and/or wax product. Additional products, such as fuel-type components (for example, without limitation, gasoline, naphtha, and diesel) and/or heavier residual components (for example, without limitation, vacuum gas oil and vacuum bottoms), are provided from the hydrocarbon feedstock. Likewise, various by-products and/or contaminants and/or waste products are removed and/or generated from the hydrocarbon feedstock in these processing flows. In general, such by-products, contaminants, and/or waste products are handled according to conventional processing methods.

Additional Processing and Process Units

Generally, a reactor includes a feed inlet and an effluent outlet. As used herein, the intermediate hydrocarbon product, the base stock, the paraffinic diesel and/or the wax are further processed in different types of reactors including a hydrotreating unit, a hydrocracking unit, hydrofinishing unit, a dewaxing unit or a combination thereof. In some examples, the reactor comprises a plurality of reactor units connected in series and/or parallel. If a configuration includes multiple reactor units in series, a gas-liquid separation is performed between reactor units to allow for removal of light ends and contaminant gases.

The "hydroprocessing unit" refers to hydrotreating reactor, a hydrocracking reactor, an aromatic saturation or a hydrofinishing reactor. The hydroprocessing unit is used to alter one or more qualities of the product. Examples of changes resulting from hydroprocessing can include, but are not limited to, reducing the heteroatom content of the product for base stocks, waxes and fuels including diesel, performing conversion on the product to achieve target properties such as VI of the base stocks, performing conversion on the product to provide Cetane improvement for diesel including, and/or performing aromatic saturation on the product for base stocks, waxes and fuels including diesel.

With regard to heteroatom removal, the conditions in a hydroprocessing unit are set to reduce the sulfur content of the hydroprocessed effluent to 250 wppm or less, or 200 wppm or less, or 150 wppm or less, or 100 wppm or less, or 50 wppm or less, or 25 wppm or less, or 10 wppm or less. In particular, the sulfur content of the hydroprocessed effluent is 1 wppm to 250 wppm, or 1 wppm to 50 wppm, or 1 wppm to 10 wppm.

Hydroprocessing can be segmented into two stages. In the present invention the first stage comprises the hydro-dealkylation reactor which produces an intermediate hydrocarbon product. Generally, conditions in a second stage process are less severe than hydroprocessing in the first stage under the present hydro-dealkylation methods. Suitable conversion conditions include temperatures of about 500° F. (260° C.) to about 840° F. (449° C.), hydrogen partial pressures of from about 1000 psig to about 2400 psig, liquid hourly space velocities of from 0.2 $hr^{-1}$ to 4 $hr^{-1}$, and hydrogen treat gas rates of from 200 SCF/BBL to 6000 SCF/BBL. Typical second stage processes to produce base stock or diesel would comprise of aromatic saturation, catalytic dewaxing and/or hydrofinishing. The second stage could include a fractionator before or after the hydrofinishing reactor to distill the hydroprocessing reactor effluent to achieve target product properties.

In accordance with an embodiment of the invention, catalytic dewaxing is performed in the second stage. Catalytic dewaxing is a subset of hydroprocessing that targets conversion of wax to ensure the base stock or diesel fuel has acceptable cold flow properties such as Pour Point and Cloud Point. The dewaxing catalysts are zeolites (and/or zeolitic crystals) that perform dewaxing primarily by isomerizing a hydrocarbon feedstock such as those described in U.S. Publication No. 2011/0180453.

In accordance with an embodiment of the invention, a hydrofinishing and/or aromatic saturation steps are further provided. The hydrofinishing and/or aromatic saturation can occur prior to dewaxing and/or after dewaxing. The hydrofinishing and/or aromatic saturation can occur either before or after fractionation. If hydrofinishing and/or aromatic saturation occurs after fractionation, the hydrofinishing is performed on one or more portions of the fractionated product, such as performed on one or more lubricant base stock or diesel distillate portions. Alternatively, the entire effluent from the last conversion or dewaxing process is hydro finished and/or undergo aromatic saturation.

In some situations, hydrofinishing and an aromatic saturation refers to a single method step performed using the same catalyst. Alternatively, one type of catalyst or catalyst system is provided to perform aromatic saturation, while a second catalyst or catalyst system can be used for hydrofinishing. Typically, a hydrofinishing and/or aromatic saturation process will be performed in a separate reactor from dewaxing or hydrocracking processes for practical reasons, such as facilitating use of a lower temperature for the hydrofinishing or aromatic saturation process.

Hydrofinishing and/or aromatic saturation catalysts include catalysts containing Group 6 metals, Group 8-10 metals, and mixtures thereof. In an embodiment, the metals include at least one metal sulfide having a strong hydrogenation function. In another embodiment, the hydrofinishing catalyst include a Group 8-10 noble metal, such as Pt, Pd, or a combination thereof. Typical support materials include amorphous or crystalline oxide materials such as alumina, silica, and silica-alumina.

Solvent processing to generate a raffinate and extract is alternative/supplemental process for reduction of aromatics to aromatic saturation. Solvent processing would most commonly occur prior to the second stage processing. It would produce a raffinate from the intermediate hydrocarbon product which would be processed by the second stage hydroprocessing units. Example solvent treatment in advance of hydroprocessing for production of base stocks and waxes is described in U.S. Pat. No. 5,911,874.

Generally, the fractioning unit includes a feed inlet and two or more fractionate outlets. In general, a fractionating unit separates a feed stream comprising multiple components into two or more fractions according to differences in component characteristics, such as volatility or the like. Fractionating can be performed at elevated temperatures and/or under vacuum conditions.

A separator can be used in-line between reactors and/or process units in either the first stage or second stage to remove gas phase sulfur and nitrogen contaminants. One option for the separator is to simply perform a gas-liquid separation to remove contaminants. Another option is to use a separator such as a flash separator that performs a separation at a higher temperature. Such a high temperature separator is used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent is also removed, thus reducing the volume of effluent that is processed in the second or other subsequent stages. Of course, any low boiling contaminants in the effluent would also be separated into the portion boiling below the temperature cut point.

When a base stock product is produced, this product can be further fractionated to form a plurality of fuel and base stock products. For example, lubricant base stock products are made corresponding to various viscosity cuts such as a 2 cSt cut, a 4 cSt cut, a 6 cSt cut, and/or a cut having a viscosity higher than 6 cSt. For example, a lubricant base oil product fraction having a viscosity of at least 2 cSt is a fraction suitable for use in low Pour Point application such as transformer oils, low temperature hydraulic oils, low viscosity engine oils, or automatic transmission fluid. A lubricant base oil product fraction having a viscosity of at least 4 cSt is a fraction having a controlled volatility and low Pour Point, such that the fraction is suitable for engine oils made according to SAE J300 in 0W- or 5W- or 10W-grades.

When wax is a target product it can be separated from the intermediate hydrocarbon product by solvent processes described in U.S. Pat. Nos. 5,911,874 and 3,644,195. 5,911,874 describes an example process to generate wax and base stock by combination of hydroprocessing and solvent processing a feedstock. U.S. Pat. No. 3,644,195 describes an example process of solvent dewaxing, de-oiling of the wax to generate a raffinate and hydroprocessing, hydrotreatment and/or hydrofinishing of the raffinate to produce semi-refined, fully refined wax products. Additionally, wax production by solvent processes can generate a de-oiling extract that comprises a foots oil or soft wax. Each of these wax products and by-products are embodiments of materials that can be generated from the hydro-dealkylation intermediate hydrocarbon product. A more comprehensive description of standard process configurations for production of wax is contained within *Developments of Petroleum* Science, Vol. 14, p. 141 (1982).

Preparing Lubricating Oils from Base Stocks

Finished lubricants (e.g., engine oils, crankcase oils, industrial lubricants) are typically prepared by blending one or more base stocks with various additives. The additives are used to improve or alter certain properties of the finished lubricant so as to meet desired performance standards. For example, additives are used to improve oxidation stability, increase viscosity, raise the viscosity index, and control formation of deposits. However, in general, additives are expensive and, furthermore, achievable additive loadings within a finished lubricant are limited due to miscibility problems and the like. For these reasons, it is generally desirable to utilize a base stock (or a blend of base stocks) that is as close to the desired performance targets of the finished lubricant as practical so that only a small amount additive is required. However, higher grade base stocks are also generally more expensive than lower grade base stocks due to greater manufacturing difficulties associated with producing the higher-grade base stocks and generally lower yields of high-performance base stocks from any given crude feed. The disclosed processes for production of Group III/III+ base stock utilizing advantageous crudes are desirable for, amongst various reasons, the ability to provide higher yield and/or lower cost production of Group III/III+ base stock for production of high grade finished lubricants.

A base stock or a base oil constitutes the major component of a finished lubricant composition and typically is present in an amount from about 50 wt. % to about 99 wt. %, from about 70 wt. % to about 95 wt. %, or from about 85 wt. % to about 95 wt. %, based on the total weight of the finished lubricant composition. As described herein, additives constitute a minor component of the finished lubricant composition and typically are present in an amount ranging from about less than 50 wt. %, less than about 30 wt. %, or less than about 15 wt. %, based on the total weight of the finished lubricant composition.

In general, many additives are commercially available materials. These additives are added separately but are usually provided in pre-combined packages be obtained from suppliers of lubricant oil additives. Additive packages with a variety of ingredients, proportions and characteristics are available and selection of the appropriate package will take the intended use of the ultimate composition into account.

Additional Embodiments

Embodiment 1. A method of hydro-dealkylation of a hydrocarbon feedstock to provide an intermediate hydrocarbon product comprising: providing a hydrocarbon feedstock comprising crude oil or a fractionated hydrocarbon stream or blend thereof having a paraffin to ring compound ratio in a VGO boiling range of between about T10 of 650° F. (340° C.) to about T90 of 1050° F. (565° C.) in accordance with ASTM D2887 greater than or equal 0.2 and at least about T50 percent of the hydrocarbon feedstock is a SIMDIS of 400° F. (204° C.); and reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product having a boiling point at T10 of greater than about 500° F.+ (260° C.+) by distillation method ASTM D7169 and a viscosity index greater than about 120 in accordance with ASTM D2270.

Embodiment 2. The method of Embodiment 1, wherein the intermediate hydrocarbon product is used to produce a base stock.

Embodiment 3. The method of Embodiment 2, further comprising hydrotreating the base stock.

Embodiment 4. The method of Embodiment 1, wherein the intermediate hydrocarbon product is used to produce a wax.

Embodiment 5. The method of Embodiment 1, wherein the intermediate hydrocarbon product is used to produce a paraffinic diesel.

Embodiment 6. A method of producing a base stock and/or wax comprising: providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2 and at least about 50 percent of the hydrocarbon feedstock is a SIMDIS of 400° F. (204° C.); reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product; and fractionating the intermediate hydrocarbon product to produce a base stock and/or a wax, wherein the base stock and the wax each have a boiling point at T10 of greater than about 650° F.+ (340° C.+) by distillation method ASTM D7169 and a viscosity index greater than about 120 in accordance with ASTM D2270.

Embodiment 7. The method of any one of the preceding Embodiments, further comprising separating the base stock from a wax with a solvent dewaxing unit.

Embodiment 8. The method of Embodiment 7, further comprising de-oiling the wax to generate a raffinate.

Embodiment 9. The method of Embodiment 8, wherein the raffinate is hydrotreated to produce semi-refined or fully refined wax product and a de-oiling extract, wherein the de-oiling extract comprises a foots oil or soft wax.

Embodiment 10. The method of any one of the preceding Embodiments, wherein the intermediate hydrocarbon product is fractionated to produce a LVGO, a MVGO, an HVGO and/or a VTB.

Embodiment 11. The method of any one of the preceding Embodiments, wherein the intermediate hydrocarbon product is used to produce slack wax, semi-refined wax, fully refined wax and/or scale.

Embodiment 12. The method of any one of the preceding Embodiments, wherein the hydrocarbon product has a viscosity index between about 130 and about 140.

Embodiment 13. The method of any one of the preceding Embodiments, wherein an aromatic content of the intermediate hydrocarbon product is reduced by a solvent extraction unit.

Embodiment 14. A method of producing at a paraffinic diesel comprising: providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2; reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product; and fractionating the intermediate hydrocarbon product to produce a paraffinic diesel, wherein the paraffinic diesel having a boiling point of at T10 of greater than about 500° F.+ (260° C.+) by distillation method ASTM D7169 and Cetane number greater than or equal to 60 in accordance with ASTM 6870.

Embodiment 15. The method of Embodiment 14, wherein the paraffinic diesel comprising less than or equal to about 5.0 ppm sulfur and less than or equal to 1.1 wt. % aromatics.

Embodiment 16. The method of any one of the preceding Embodiments, wherein the intermediate hydrocarbon product is selected from an atmospheric tower bottom, a vacuum tower bottom and a vacuum gas oil.

Embodiment 17. The method of any one of the preceding Embodiments, wherein the paraffin to ring compound ratio is between about 0.4 to about 1.2, or about 0.6 to about 1.2.

Embodiment 18. The method of any one of the preceding Embodiments wherein the hydrocarbon feedstock has an API gravity between about 35 and about 55, about 40 and about 55, or about 45 and about 55.

Embodiment 19. The method of Embodiment 18, wherein the API gravity is 35 and about 55.

Embodiment 20. The method of any one of the preceding Embodiments wherein the hydrocarbon feedstock comprising less than 0.5 wt. % sulfur.

Embodiment 21. The method any one of the preceding Embodiments, wherein the hydrocarbon feedstock is reacted at a pressure between about 400 psig to about 2400 psig.

Embodiment 22. The method of any one of the preceding Embodiments, wherein the hydrocarbon feedstock comprises less than 2000 ppm, 50 to 1500 ppm or 50 to 400 ppm of nitrogen at 650° F. (340° C.).

Embodiment 23. The method of any one of the preceding Embodiments, wherein the catalyst is a low acidity catalyst.

Embodiment 24. The method of any one of the preceding Embodiments, wherein the catalyst is a high acidity catalyst.

Embodiment 25. The method of any one of the preceding Embodiments, wherein the catalyst is NiMo, CoMo, NiW or a hydrotreating catalyst.

Embodiment 26. The method of any one of the preceding Embodiments, wherein the hydrocarbon feedstock is about 0.2 to about 4.0 LHSV per hour.

Embodiment 27. The method of any one of the preceding Embodiments, wherein the hydrogen is provided between about 200 to about 6000 SCF/BBL.

Embodiment 28. The method of any one of the preceding Embodiments, wherein the hydrocarbon feedstock has not been subject to prior fractionation.

Embodiment 29. The method of any one of the preceding Embodiments, wherein solvent is not used in reacting the hydrocarbon feedstock and hydrogen.

Embodiment 30. The method of any one of the preceding Embodiments, wherein the hydrocarbon feedstock is at least 80 wt. % petroleum hydrocarbon.

Embodiment 31. The method of any one of the preceding Embodiments, wherein the hydrocarbon product is further processed by aromatic saturation, dewaxing, or hydrofinishing.

Embodiment 32. The method of any one of the preceding Embodiments, wherein the liquid hourly space velocity of the hydrocarbon feedstock is between about 0.2 to about 0.4 per hour and the hydrotreating catalyst is not acidic.

EXAMPLES

The features of the present disclosure are described in the following non-limiting examples.

Example 1

Process Configuration

The present methods use a hydro-dealkylation process to selectively convert heavy alkylated ring (aromatic, naphthene) species into lower molecular weight paraffins and ring structures through a thermal cleavage of a C—C bond adjacent to a ring. Reaction Scheme 1. For this conversion, a fixed-bed reactor operating within the boundaries set out in Table 1 were used. The hydrocarbon feedstock set out in Table 2 and FIG. 1 are fed to a hydroprocessing unit (i.e., a fixed-bed reactor) was a crude oil, blend or fractionated stream as set out by FIG. 2. The hydrocarbon feedstock is then provided to the fixed bed reactor under hydrogen pressure. After the reaction is complete, effluent from the hydroprocessing unit is fractionated into distillate cuts/streams for downstream applications. Applications for various cuts include, but are not limited to, naphtha, kerosene/jet and diesel for atmospheric distillate, base stocks for VGO, bright stock for VTB, fuel oil for VTB or additional hydroprocessing (FCC, Coker, and the like) for any cut.

Figure 3:
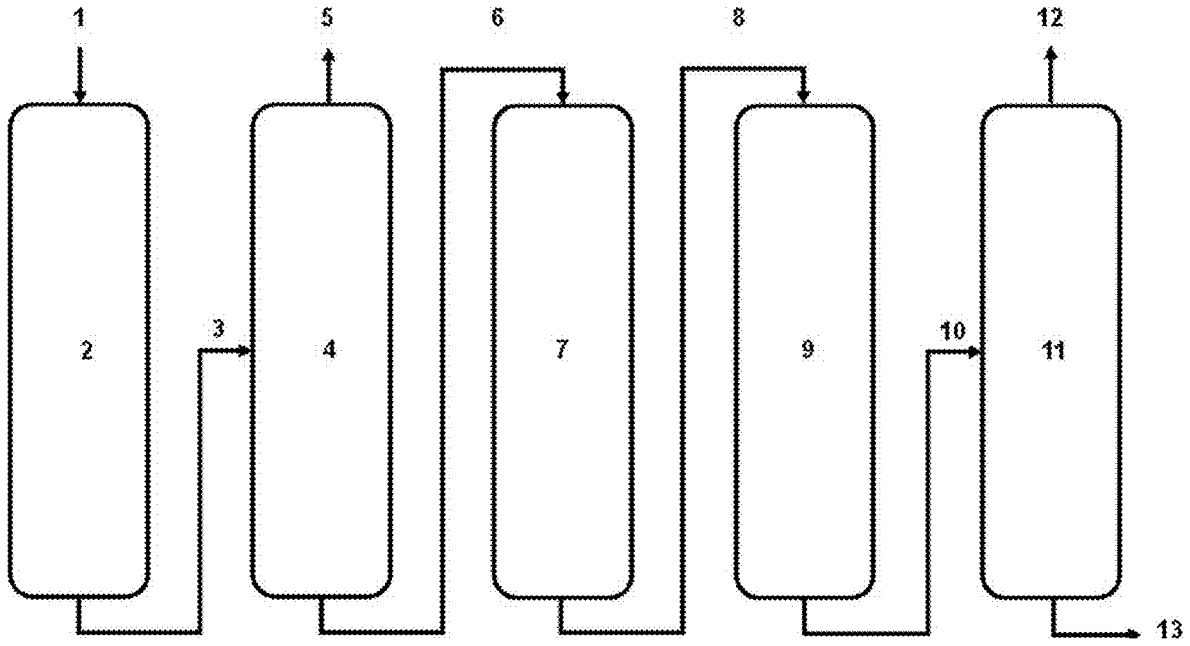
FIG. 3 is a general process flowchart for hydro-dealkylation in combination with a base stock plant designed to process full range of crude, atmospheric tower bottoms (ATB), vacuum gas oil (VGO), vacuum tower bottoms (VTB) from fixed-bed reactor inlet to a lube plant (catalytic dewaxing and hydrofinishing) to the lube fractionator.

A general process flow for hydro-dealkylation as part of a base stock plant designed to process full range crude, ATB, VGO, VTB from the fixed-bed reactor inlet to lube plant where catalytic dewaxing and hydrofinishing are performed and further to lube fractionator is shown in FIG. 3. Although FIG. 3 is one type of process configuration, there are numerous iterations available for consideration and can be developed as needed. FIG. 3 illustrates just one example of the present hydro-dealkylation process configurations that can be integrated into a Group II and Group III/III+ base stock manufacturing plant, and as an implementation of present methodologies.

As shown in FIG. 3, the hydrocarbon feedstock is converted into base stocks and bright stock through blocked operation or co-processing. The hydrocarbon feedstock 1 can be whole crude, ATB, VGO or VTB. The hydrocarbon feedstock is processed by the hydro-dealkylation reactor 2. The hydro-dealkylation effluent 3 of the hydro-dealkylation reactor 2 would then be fractionated in a fractionating unit 4 also referred to as a fractionator. The fractionator 4 provides at least the fractionator overhead and fuels 5 and at least one cut one cut of bottoms 6 that would be further processed. The fractionator overhead and fuels 5 is not intended for further processing would be converted through conventional fractionation technology into fuel cuts such as but not limited to naphtha, kerosene, diesel and paraffinic diesel. The cuts (also referred to sometimes as "fractions," "fractionates," "side streams," and/or "streams") generated from distillation have unique properties such as high aromatic kerosene and high paraffinic diesel depending on the process severity of the hydro-dealkylation process. The fractionator hydro-dealkylation bottoms cut(s) 6, also described as the intermediate hydrocarbon product, is then processed by the base stock plant 7, 8, 9, 10, 11, 12 and 13. In this example the hydro-dealkylation bottoms cut 6 could also be a VGO with a boiling point at T10 of greater than about 500° F.+ (260° C.+).

The fractionator hydro-dealkylation bottoms 6 is provided to aromatic saturation and/or catalytic dewaxing reactor(s) 7. The aromatic saturation and/or catalytic dewaxer 7 provides a catalytic dewaxer effluent 8. The catalytic dewaxer effluent 8 is provided to the hydrofinisher reactor 9. The hydrofinisher reactor 9 provides a hydrofinisher effluent 10 to a lube fractionator 11. The lube fractionator 11 provides at least fractionator overhead and fuels 12 and at least one cut of the base stock 13. In this example the upper fractionate is the fractionator overhead and fuels 12 and the lower fractionate 13 is the base stock.

Numerous iterations on the hydro-dealkylation process could be considered such as but not limited to: hydro-dealkylation for production of high-quality dewaxed fuels by inclusion of a dewaxing catalyst in the hydro-dealkylation reactor or an acidic hydrotreating catalyst; hydro-dealkylation to generate an effluent that is suitable for solvent dewaxing and production of wax and and/or Group II/III base stocks; or hydro-dealkylation that produces effluent suitable for FCC processing. Iterations of the process configuration after hydro-dealkylation could be considered such as but not limited to: hydrotreating, aromatic saturation and/or catalytic dewaxing of the fuel diesel cut to reduce contaminants and improve properties of the paraffinic diesel, hydrocracking before or after catalytic dewaxing, aromatic saturation before or after catalytic dewaxing, hydrofinishing before or after catalytic dewaxing, hydrofinishing after the lube fractionator.

Example 2

Hydro-Dealkylation Processes Targeting Fuels and Base Stock from 880° F.+ VTB

A fixed bed pilot plant operation that operated under hydro-dealkylation conditions for initial scoping of technology feasibility. The feed to the pilot plant was an 880° F.+ VTB of a Crude Class II feed (Table 5) with a SIMDIS T50 percent of 975° F. (525° C.). The feed was produced by atmospheric and vacuum distillation of a whole crude. The hydro-dealkylation reactor consisted for two catalyst containing barrels connected in series. The first barrel contained KF-860 (5 cc) loaded on HRK-1448 (32 cc). The second barrel contained Celestia (40 cc). The operating pressure for the experiment was 1000 psig hydrogen. The hydrogen to liquid feed ratio was 2000 SCF/BBL. The linear hourly space velocity (LHSV) of the experiment was 0.5 $hr^{-1}$. The reactor temperature of barrel 1 and barrel 2 was 780° F. (415° C.).

TABLE 5

Selected Feed Properties of VTB Example in Relation to Table 2

| Property | Feedstock |
|---|---|
| Crude Class | II |
| API | 44 |
| Paraffin to Ring Compound Ratio VGO (650° F. to 1050° F.) | 0.4 |
| Sulfur 650° F.+, wt. % | 0.2 |
| Nitrogen 650° F.+, ppm | 1511 |
| NHI 650° F.+, wt. % | 0.06 |

Figure 4:
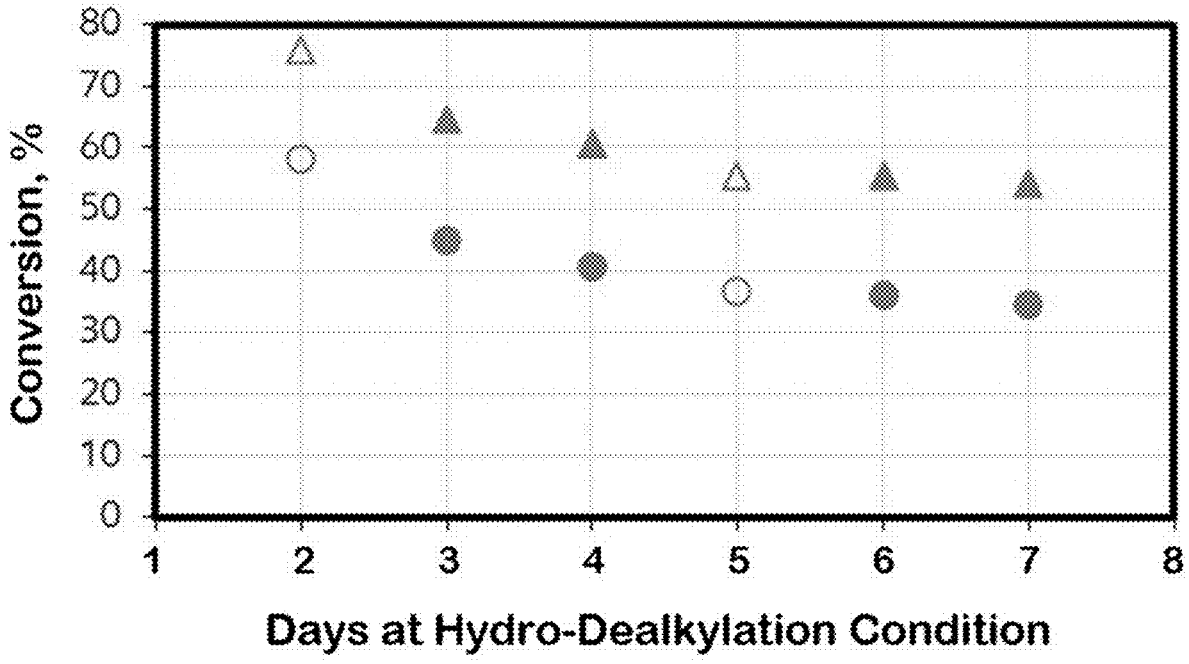
FIG. 4 shows 700° F.+ and 900° F.+ boiling point conversion for hydro-dealkylation mass balances made in accordance with Example 2, Table 5.

The process was monitored by boiling point conversion measured relative to the SIMDIS of the hydrocarbon feedstock at 700° F. and 900° F. The conversion achieved under the process conditions ranged between 75 wt. % to 55 wt. % measured at the reference temperature of 900 F ° (480° C.) and 60 wt. % to 35 wt. % measured at the reference temperature of 700 F ° (370° C.), See, FIG. 4.

Figure 5:
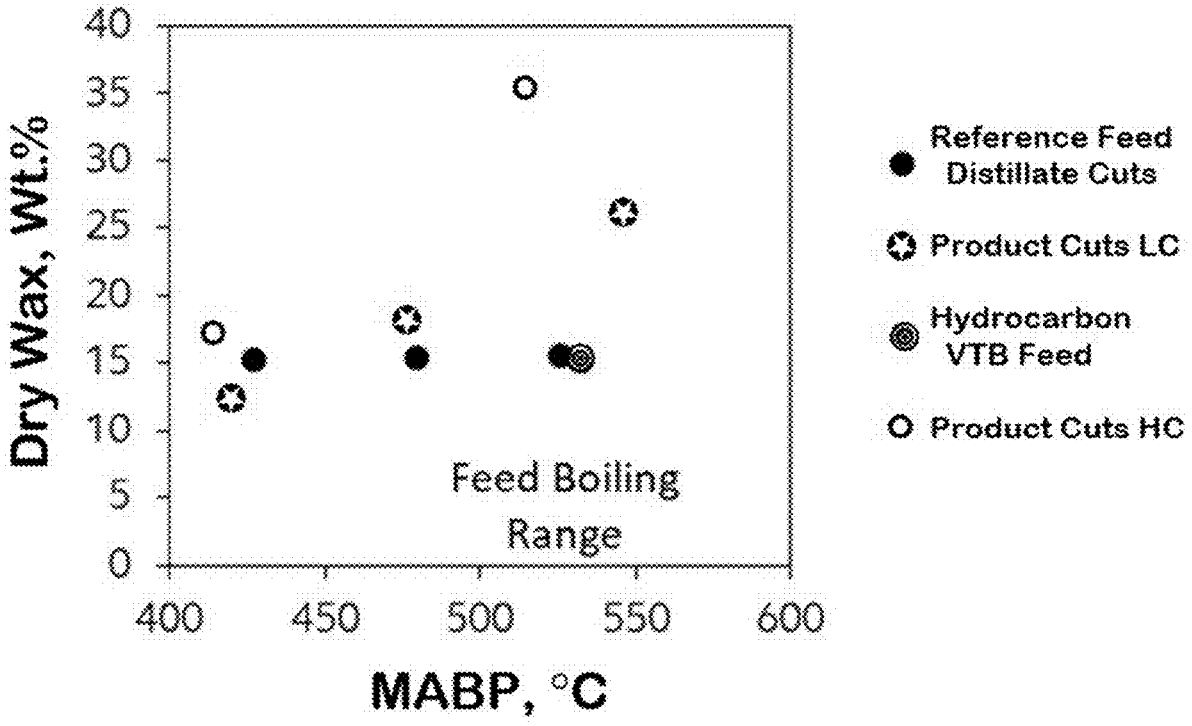
FIG. 5 is a graph showing dry wax concentration of Example 2 versus MABP of feed VGO and VTB in comparison to hydro-dealkylation reactor effluent VGO and VTB.
Figure 6:
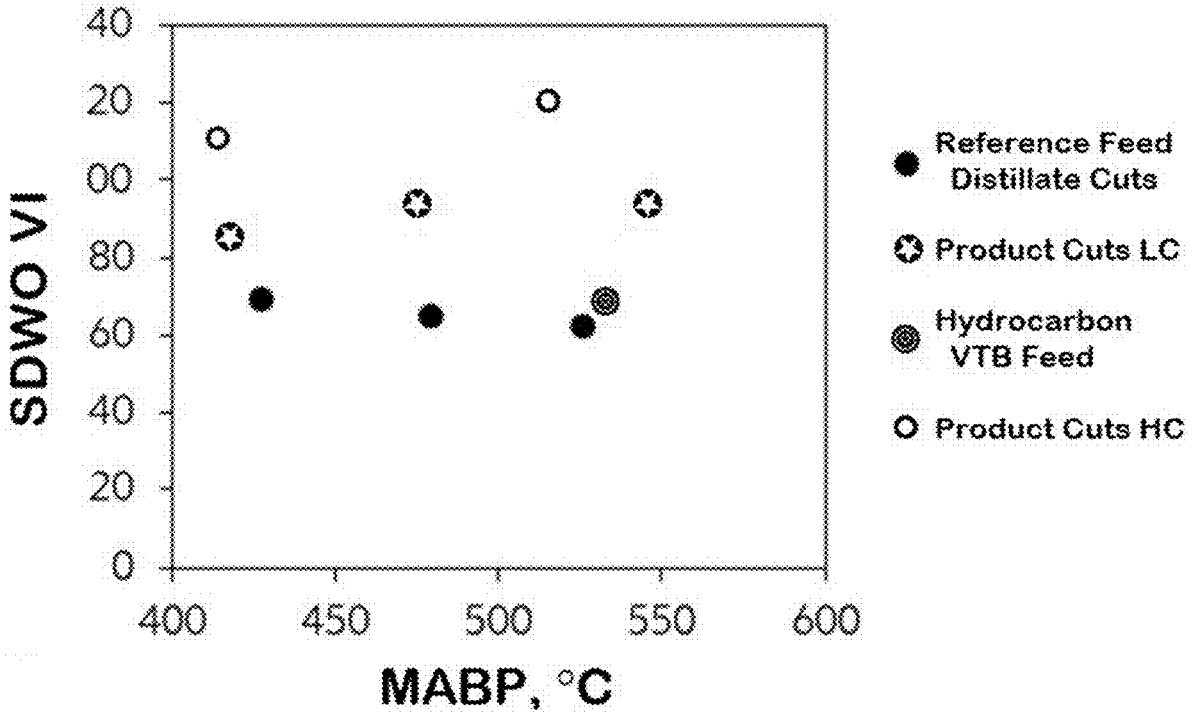
FIG. 6 is a graph showing SDWO VI of Example 2 versus MABP of feed VGO and VTB in comparison to hydro-dealkylation reactor effluent VGO and VTB.

It was found that the HC condition was particularly advantageous as it led to significant improved wax concentration (from 15 wt. % to 36 wt. %), and improved SDWO VI (from 69 to 120) in the original boiling range of the feed (880° F.+, MABP 515° C., T10 860° F. (460° C.)). See, FIG. 5 and FIG. 6 where the acronym LC refers to low conversion/35% 700° F. conversion. The acronym HC refers to high conversion/60% 700° F. conversion. The black circle data points represent corresponding cuts of whole crude oil distilled on small scale to provide a reference point to properties of the feed relative to hydro-dealkylation products. The circle data point shaped as a target represents the 880° F.+ VTB feed.

For perspective 880° F.+ VTB feed could be deasphalted and solvent processed to a Group I bright stock type quality (SDWO VI of 69) and the intermediate hydrocarbon product 880° F.+ VTB SDWO from the HC condition could be further processed in a second stage to achieve a Group II bright stock type quality (SDWO VI of 120). The intermediate hydrocarbon product could also be solvent dewaxed to collect a petrolatum wax and the dewaxed oil could be further processed to produce a Group II bright stock without the need of a solvent deasphalting process at any manufacturing stage.

Comparing conversion levels (HC to LC) provides an indication of the benefit of conversion to the rain down of molecules generated by hydro-dealkylation to lower boiling ranges (below 880° F.+ of the feedstock). Rain down refers to molecules that were converted under the hydro-dealkylation condition and have a lower boiling point than in the feedstock. The HC condition as compared to the LC condition improved both the wax (from 12 wt. % to 17 wt. %) and SDWO VI (from 85 to 110) properties of the VGO (LVGO, MABP ~415° C., T10 ~690° F. (~365° C.)) derived from the intermediate hydrocarbon product. The VGO distillate of the intermediate hydrocarbon product of the HC condition is suitable for production of a Group III base stock by further processing in a second stage that includes catalytic dewaxing. Alternatively, the intermediate hydrocarbon product could be solvent dewaxing and processed to produce a refined wax, and the resulting dewaxed oil could be further processed in a second stage to produce a Group II base stock.

This example illustrates that an intermediate hydrocarbon product resulting from hydro-dealkylation processing of an 880° F.+ VTB from a Class II Crude is suitable for the production of high-quality base stocks (VI>120) and/or wax production.

Example 3

Hydro-Dealkylation Processes Targeting Fuels and Base Stock from 650° F.+ ATB

A fixed-bed reactor pilot plant operation under hydro-dealkylation conditions for technology feasibility of ATB (650° F.+, atmospheric tower bottoms) processing was performed. The hydrocarbon feedstock (Table 6) to the pilot plant was 650° F.+ ATB derived by distillation from a 47 API crude oil blend that would be classified as a Crude Oil Class III (Paraffin to ring compound ratio of 0.7) SIMDIS T50 percent of 800° F. (425° C.). The pilot operation included two reactor barrels. Reactor barrel 1 was loaded with RT-621 (38 cc) and reactor barrel 2 was loaded with Celestia (38 cc). The operating pressure was 2050 psig hydrogen. The hydrogen to liquid feed ratio was 4000 SCF/BBL. The space velocity (LHSV) was 0.5 $hr^{-1}$. The reactor temperature of reactor barrel 1 and reactor barrel 2 ranged from 770° F. to 780° F.

The process was monitored by boiling point conversion measured relative to the SIMDIS of the hydrocarbon feedstock at 700° F. and 900° F. Conversion relevant to base stock and wax production in the VGO and VTB range was achieved under the process boiling point conversion between 55% to 30% at 700° F. and 74% to 38% at 900° F. It was found that 55% conversion at 700 ° F. conversion was the more advantageous condition versus 30% conversion at 700° F. for base stock, wax and paraffinic diesel applications.

Figure 7:
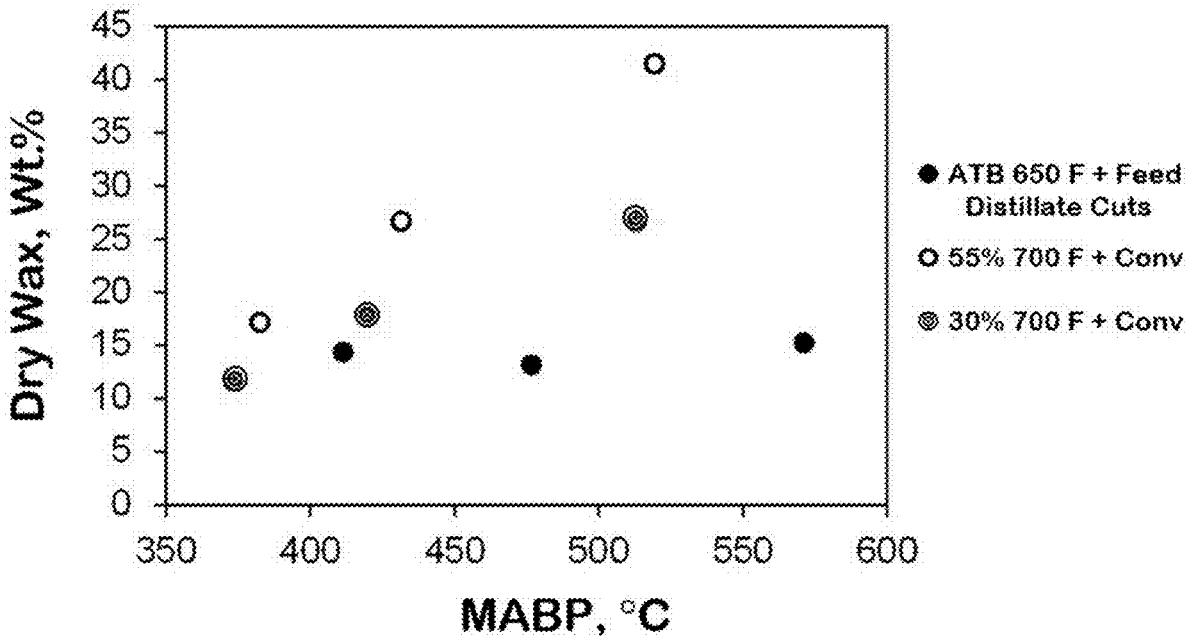
FIG. 7 is a graph showing dry wax concentration of Example 3 versus MABP of VGO and VTB of the feed in comparison to hydro-dealkylation reactor effluent VGO and VTB.
Figure 8:
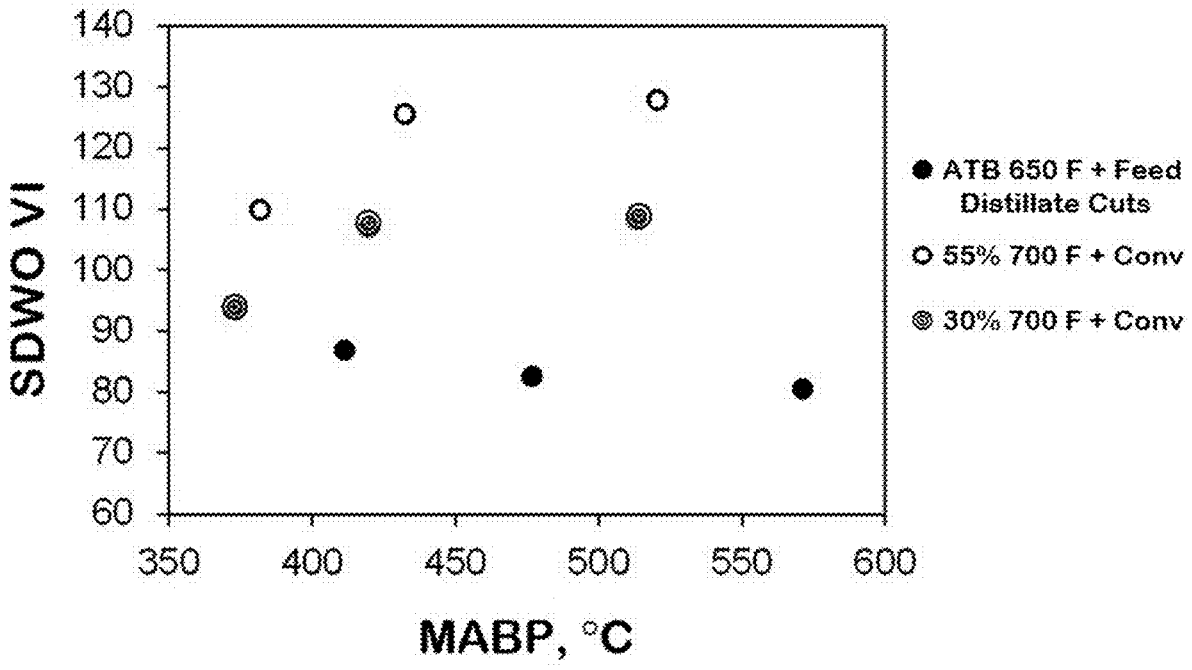
FIG. 8 is a graph showing SDWO VI concentration of Example 3 versus MABP of VGO and VTB of the feed in comparison to hydro-dealkylation reactor effluent VGO and VTB.

Wax concentration improved (from 17 wt. % to 27 wt. %), SDWO VI improved (from 107 to 126) and VI improved (from 120 to 144) in the VGO of the intermediate hydrocarbon product in the LVGO boiling range (MABP 420, T10 712° F. (378° C.) and MABP 432° C., T10 736° F. (391° C.)) from 30% conversion at 700° F. to 55% conversion at 700° F. of the feedstock. See, FIG. 7 and FIG. 8 where the black data points represent distilled VGO cuts of feedstock (650° F.+ ATB derived from 47 API Crude) (LVGO, MABP 411° C.), (MVGO, MABP 477° C.), (VTB, MABP 571° C.). The intermediate hydrocarbon product LVGO of the 55% conversion at 700° F. condition is suitable for subsequent hydroprocessing in a second stage to produce a Group III and/or Group III+ base stock. Alternatively, the LVGO could be solvent dewaxed and processed to produce a refined wax, and the resulting dewaxed oil could be further processed in a second stage to produce a Group III base stock.

Wax concentration improved (from 27 wt. % to 41 wt. %), SDWO VI improved (from 108 to 127) and the VI improved (from 136 to 148) in the VTB of the intermediate hydrocarbon product (MABP 513, T10 856° F. (458° C.) and 519° C., T10 880° F. (471° C.)) from 30% conversion at 700° F. to 55% conversion at 700° F. of the feedstock. See, FIG. 7 and FIG. 8 where the black data points represent distilled VGO cuts of feedstock (650° F.+ ATB derived from 47 API Crude) (LVGO, MABP 411° C.), (MVGO, MABP 477° C.), (VTB, MABP 571° C.). The VTB is suitable for dewaxing to produce petrolatum wax and hydroprocessing to produce a Group II bright stock without the need of a solvent deasphalting process at any stage.

For paraffinic diesel applications process conversion in the range of 67% to 55% and 30% at 700° F. and 86% to 74% and 38% at 900° F. were found to be relevant. The diesel cut had a T50 of 590° F. and a T90 of 670° F. The Cetane number improved (from 52, to 58 to 63) in the diesel cut from concersion at 700° F. spanning 30%, 55% and 67% conditions. Across the boiling point range the Cloud Point (range −9° C. to −11° C.) and Pour Point (range −10° C. to −12° C.) properties of the diesel cut were relatively unchanged. The intermediate hydrocarbon product from the 67% conversion condition was most preferred for subsequent processing to paraffinic diesel. This material could be converted to paraffinic diesel with additional processing including hydrotreating to reduce sulfur, aromatic saturation to reduce aromatics and catalytic dewaxing to fine tune cold flow properties. The intermediate hydrocarbon product from the 55% conversion condition could also be converted to paraffinic diesel with additional processing with similar steps to the 67% boiling point conversion sample but would require additional process optimization to ensure Cetane and specifications are achieved.

For this hydrocarbon feedstock, it was deemed that 55% conversion at 700° F. and 75% at 900° F. was appropriate to generate an intermediate hydrocarbon product VGO suitable to continued processing for production of wax and high-quality Group III and Group III+ base stocks. The VTB of the same intermediate hydrocarbon product is suitable for production of petrolatum wax and Group II bright stock. The 67% conversion at 700° F. and 86% at 900° F. was suitable for the production of paraffinic diesel.

TABLE 6

Selected Feed Properties of 650° F.+ ATB Example in Relation to Table 2.

| Property | Feedstock |
|---|---|
| Crude Class | III |
| API | 47 |
| Paraffin to Ring Compound VGO (650° F. to 1050° F.) | 0.7 |
| Sulfur 650° F.+, wt. % | 0.1 |
| Nitrogen 650° F.+, ppm | 958 |
| NHI 650° F.+, wt. % | 0.4 |

Many alterations, modifications, and variations will be apparent to those skilled in the art in light of the foregoing description without departing from the spirit or scope of the present disclosure and that when numerical lower limits and numerical upper limits are listed herein, ranges from any lower limit to any upper limit are contemplated.

What is claimed is:

1. A method of hydro-dealkylation of a hydrocarbon feedstock to provide an intermediate hydrocarbon product comprising:

providing a hydrocarbon feedstock comprising crude oil or a fractionated hydrocarbon stream or blend thereof having a paraffin to ring compound ratio in a VGO boiling range of between about T10 of 650° F. (340° C.) to about T90 of 1050° F. (565° C.) in accordance with ASTM D2887 greater than or equal 0.2 and at least about T50 percent of the hydrocarbon feedstock is a SIMDIS of 400° F. (204° C.); and reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product having a boiling point at T10 of greater than about 500° F.+ (260° C.+) to 650 CF (340°F.) by distillation method ASTM D7169 and a viscosity index greater than about 120 in accordance with ASTM D2270.

2. The method of claim 1, wherein the intermediate hydrocarbon product is used to produce a base stock.

3. The method of claim 2, further comprising hydrotreating the base stock.

4. A method of producing a base stock and/or wax comprising:

providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2 and at least about 50 percent of the hydrocarbon feedstock is a SIMDIS of 400° F. (204° C.);

reacting the hydrocarbon feedstock and hydrogen in the presence of a hydrotreating catalyst at a temperature between about 500° F. (260° C.) to about 1200° F. (650° C.) and at pressure between about 400 psig to about 2400 psig to produce an intermediate hydrocarbon product; and fractionating the intermediate hydrocarbon product to produce a base stock and/or a wax, wherein the base stock and the wax each have a boiling point at T10 of greater than about 650° F.+ (340° C.+) by distillation method ASTM D7169 and a viscosity index greater than about 120 in accordance with ASTM D2270.

5. The method of claim 4, further comprising separating the base stock from a wax with a solvent dewaxing unit.

6. The method of claim 5, further comprising de-oiling the wax to generate a raffinate.

7. The method of claim 6, wherein the raffinate is hydrotreated to produce semi-refined or fully refined wax product and a de-oiling extract, wherein the de-oiling extract comprises a foots oil or soft wax.

8. The method of claim 5, wherein the intermediate hydrocarbon product is fractionated to produce a LVGO, a MVGO, an HVGO and/or a VTB.

9. The method of claim 5, wherein the intermediate hydrocarbon product is used to produce slack wax, semi-refined wax, fully refined wax and/or scale.

10. The method of claim 5, wherein the hydrocarbon product has a viscosity index between about 130 and about 140.

11. The method of claim 5, wherein an aromatic content of the intermediate hydrocarbon product is reduced by a solvent extraction unit.

12. A method of producing at a paraffinic diesel comprising:

providing a hydrocarbon feedstock comprising crude oil or a fractionated hydrocarbon stream or blend thereof having a paraffin to ring compound ratio in a VGO boiling range of between about 650° F. (340° C.) to about 1050° F. (565° C.) greater than or equal 0.2;

reacting the hydrocarbon feedstock and hydrogen in the presence of a hydrotreating catalyst at a temperature between about 500° F. (260° C.) to about 120020 F. (650° C.) and at pressure between about 400 psig to about 2400 psig to produce an intermediate hydrocarbon product; and fractionating the intermediate hydrocarbon product to produce a paraffinic diesel, wherein the paraffinic diesel having a boiling point of at T10 of greater than about 500° F.+ (260° C.+) by distillation method ASTM D7169 and Cetane number greater than or equal to 60 in accordance with ASTM 6870.

13. The method of claim 12, wherein the paraffinic diesel comprising less than or equal to about 5.0 ppm sulfur and less than or equal to 1.1 wt. % aromatics.

14. The method of claim 12, wherein the intermediate hydrocarbon product is selected from an atmospheric tower bottom, a vacuum tower bottom and a vacuum gas oil.

15. The method of claim 12, wherein the paraffin to ring compound ratio is between about 0.4 to about 1.2.

16. The method of claim 12 wherein the hydrocarbon feedstock has an API gravity between about 35 and about 55.

17. The method of claim 12 wherein the hydrocarbon feedstock comprising less than 0.5 wt. % sulfur.

18. The method of claim 12, wherein the hydrocarbon feedstock is reacted at a pressure between about 400 psig to about 2400 psig.

19. The method of claim 12, wherein the hydrocarbon feedstock comprises less than 2000 ppm, 50 to 1500 ppm or 50 to 400 ppm of nitrogen at 650° F. (340° C.).

20. The method of claim 12, wherein the catalyst is NiMo, CoMo, NiW or a hydrotreating catalyst.

21. The method of claim 12, wherein the hydrocarbon feedstock is about 0.2 to about 4.0 LHSV per hour.

22. The method of claim 12, wherein the hydrogen is provided between about 200 to about 6000 SCF/BBL.

23. The method of claim 12, wherein the hydrocarbon feedstock is at least 80 wt. % petroleum hydrocarbon.

24. The method of claim 12, wherein the hydrocarbon product is further processed by aromatic saturation, dewaxing, or hydrofinishing.

25. The method of claim 12, wherein the liquid hourly space velocity of the hydrocarbon feedstock is between about 0.2 to about 0.4 per hour and the hydrotreating catalystis not acidic.

* * * * *